US008277270B2

(12) United States Patent
Ryuman

(10) Patent No.: US 8,277,270 B2
(45) **Date of Patent: *Oct. 2, 2012**

(54) BOAT PROPULSION UNIT

(75) Inventor: Mitsuhiro Ryuman, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 520 days.

This patent is subject to a terminal disclaimer.

(21) Appl. No.: 12/399,141

(22) Filed: Mar. 6, 2009

(65) Prior Publication Data

US 2009/0247025 A1 Oct. 1, 2009

(30) Foreign Application Priority Data

Mar. 31, 2008 (JP) ..... 2008-090885

(51) Int. Cl.
*B63H 21/21* (2006.01)

(52) U.S. Cl. ..... 440/86

(58) Field of Classification Search ..... 701/21; 440/1, 84, 86; 114/144 RE, 144 A; 192/109 F, 192/21, 51; 477/180

See application file for complete search history.

(56) References Cited

U.S. PATENT DOCUMENTS

| | | | | |
|---|---|---|---|---|
| 4,836,809 | A * | 6/1989 | Pelligrino | 440/2 |
| 5,171,170 | A * | 12/1992 | Ridder et al. | 440/1 |
| 5,336,120 | A * | 8/1994 | Maurer et al. | 440/84 |
| 5,879,210 | A * | 3/1999 | Goto et al. | 440/75 |
| 6,679,740 | B1 * | 1/2004 | Imanaka et al. | 440/75 |
| 2007/0017426 | A1 * | 1/2007 | Kaji et al. | 114/144 RE |

FOREIGN PATENT DOCUMENTS

JP 3499204 B2 2/2004

* cited by examiner

*Primary Examiner* — Edwin Swinehart
(74) *Attorney, Agent, or Firm* — Keating & Bennett, LLP

(57) ABSTRACT

A boat propulsion unit includes a power source, a propeller, a shift position switching mechanism, a control device, and a retention switch. The propeller is driven by the power source to generate propulsive force. The shift position switching mechanism has an input shaft connected to a side of the power source, an output shaft connected to a side of the propeller, and clutches that change a connection state between the input shaft and the output shaft. A shift position of the shift position switching mechanism is switched among forward, neutral, and reverse by engaging and disengaging the clutches. The control device adjusts an engagement force of the clutches. The retention switch is connected to the control device. When the retention switch is turned on by an operator, the control device controls the engagement force of the clutches to retain a hull in a predefined position. The boat propulsion unit provides a boat propulsion unit that can accurately retain a boat at a fixed point.

11 Claims, 35 Drawing Sheets

| Part name (reference numeral) | ○ : Clutch engaged | | × : Clutch disengaged | | |
|---|---|---|---|---|---|
| Transmission gear ratio switching hydraulic clutch (53) | × | ○ | × (○) | × | ○ |
| First shift switching hydraulic clutch (61) | × | × | × | ○ | ○ |
| Second shift switching hydraulic clutch (62) | ○ | ○ | × | × | × |
| One-way clutch (58) | Prevents reverse rotation | Allows forward rotation | Does not operate | Prevents reverse rotation | Allows forward rotation |
| Shift position | Low-speed forward | High-speed forward | Neutral | Low-speed reverse | High-speed reverse |

FIG. 7

BOAT PROPULSION UNIT

BACKGROUND OF THE INVENTION

1. Field of the Invention

The present invention relates to a boat propulsion unit.

2. Description of the Related Art

JP-B-3499204 discloses an automatic dynamic positioning system (DPS) as a fixed point retention control system for a boat. Specifically, the DPS drives an actuator based on the deviation between a positional signal from a global positioning system (GPS) and a positional command value.

However, it is difficult to accurately retain the boat at a fixed point in the fixed point retention control method described in JP-B-3499204.

SUMMARY OF THE INVENTION

In order to overcome the problem described above, preferred embodiments of the present invention provide a boat propulsion unit that can accurately retain a boat at a fixed point.

A boat propulsion unit according to a preferred embodiment of the present invention includes a power source, a propeller, an output shaft, a shift position switching mechanism, a control device, and a retention switch. The propeller is driven by the power source to generate propulsive force. The shift position switching mechanism has an input shaft, an output shaft, and a clutch. The input shaft is connected to a side of the power source. The output shaft is connected to a side of the propeller. The clutch changes a connection state between the input shaft and the output shaft. A shift position of the shift position switching mechanism is switched among forward, neutral, and reverse by engaging and disengaging the clutch. The control device adjusts engagement force of the clutch. The retention switch is connected to the control device. When the retention switch is turned on by an operator, the control device controls the engagement force of the clutch such that a hull is retained in a predetermined or desired position.

According to preferred embodiments of the present invention, it is possible to achieve a boat propulsion unit that can accurately retain a boat at a fixed point.

Other features, elements, steps, characteristics and advantages of the present invention will become more apparent from the following detailed description of preferred embodiments of the present invention with reference to the attached drawings.

BRIEF DESCRIPTION OF THE DRAWINGS

FIG. 7 is a table showing engagement states of first to third hydraulic clutches and shift positions of the shift mechanism.

DETAILED DESCRIPTION OF THE PREFERRED EMBODIMENTS

Preferred embodiments of the present invention will be described hereinafter with reference to a boat 1 shown in FIG. 1, a boat 2 shown in FIG. 21, and a boat 3 shown in FIG. 34. However, the preferred embodiments below are merely examples of preferred embodiments of the present invention, and the present invention is not limited to the preferred embodiments described below.

Furthermore, a boat according to a preferred embodiment of the present invention may have a boat propulsion unit other than an outboard motor, unlike the preferred embodiments below. The boat propulsion unit in a preferred embodiment of the present invention may be, for example, a so-called inboard motor or a so-called stern drive. The stern drive is also referred to as an inboard-outboard motor. The "stern drive" refers to a boat propulsion unit that has at least a power source mounted on a hull. The "stern drive" also includes a unit that has something other than a propulsion unit mounted on a hull.

First Preferred Embodiment

Figure 1:
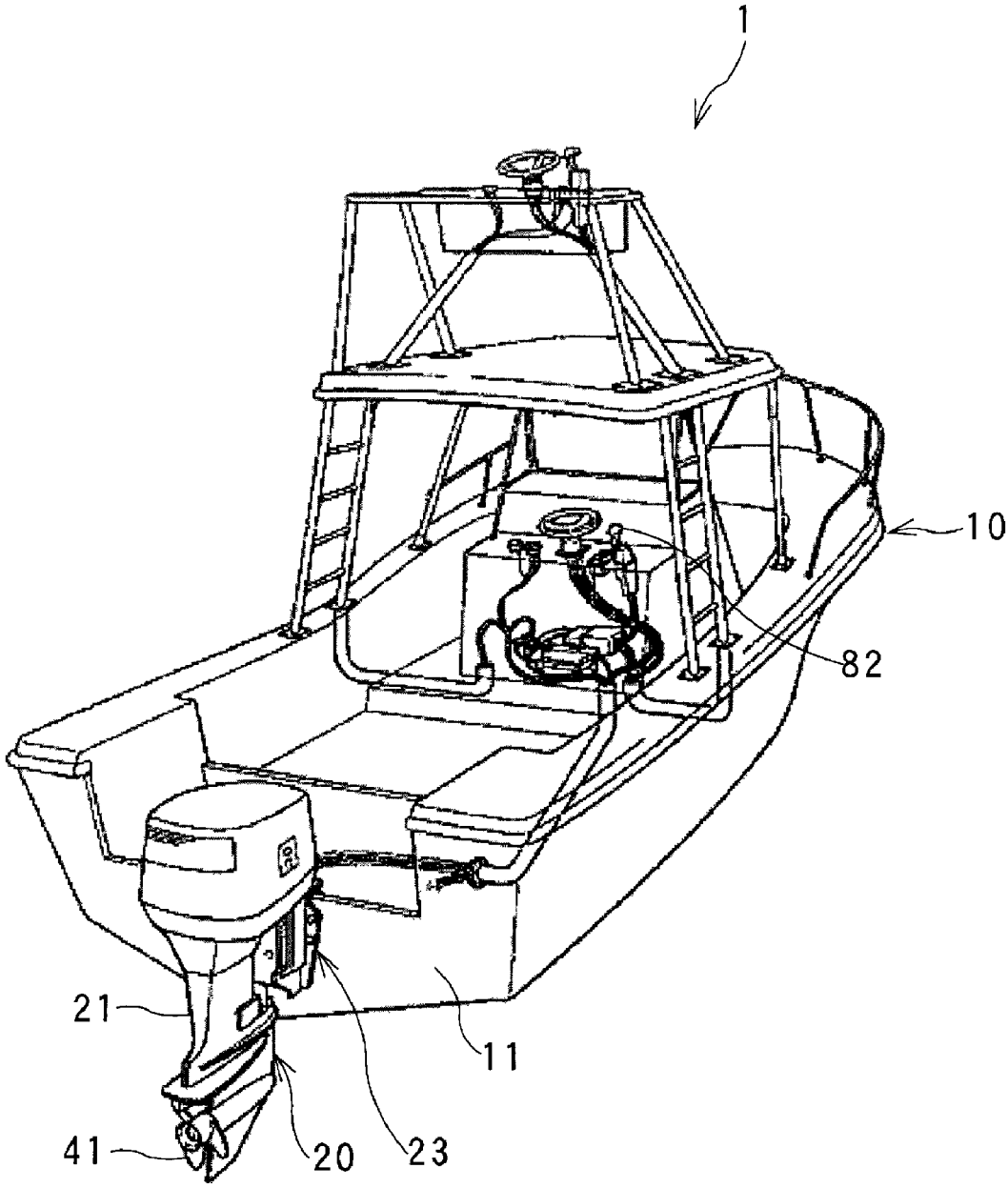
FIG. 1 is a view of a boat according to a first preferred embodiment when viewed from an obliquely rearward direction.
Figure 2:
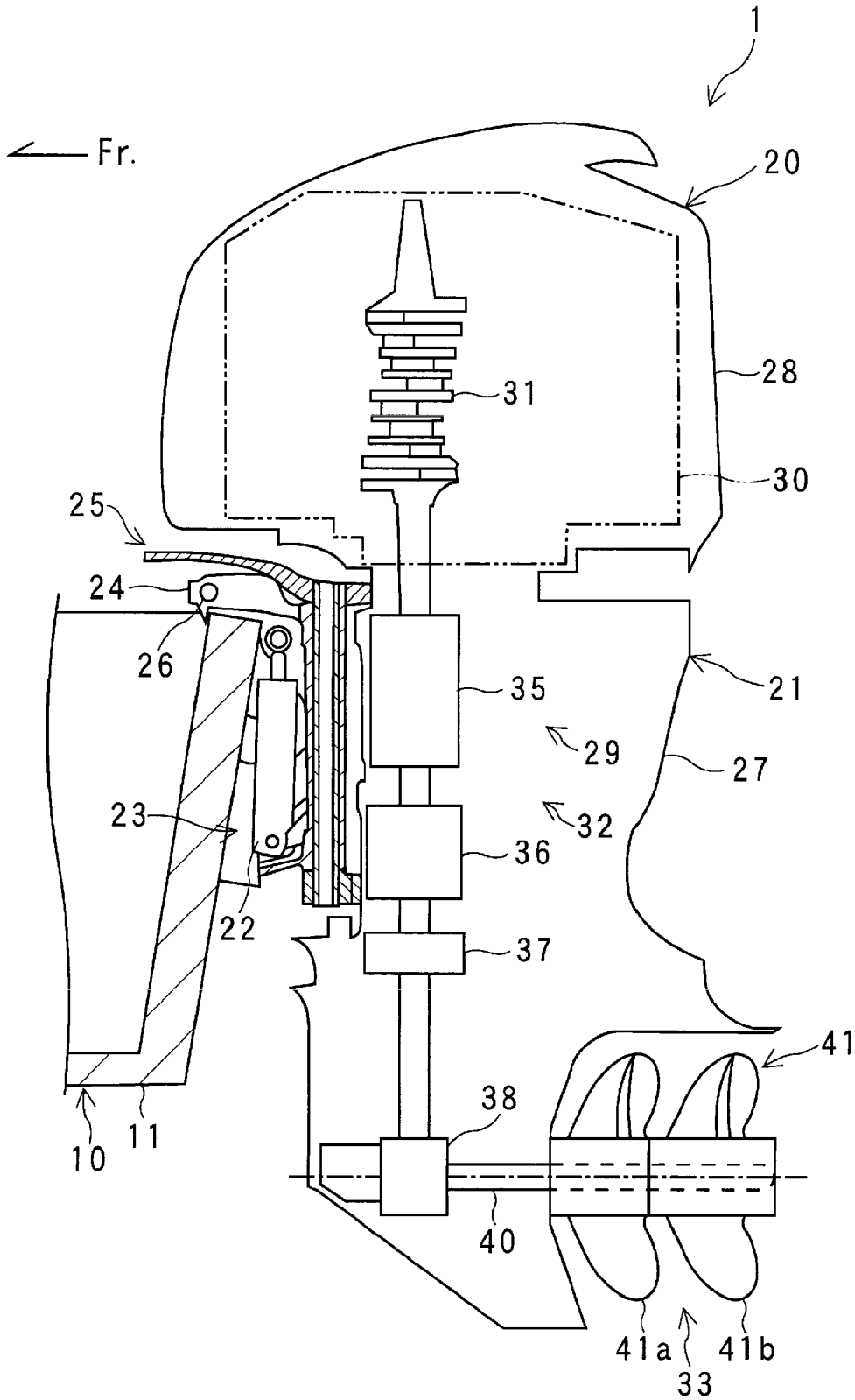
FIG. 2 is a partial cross-sectional view of a stern of the boat according to the first preferred embodiment of the present invention when viewed from a side.

As shown in FIG. 1 and FIG. 2, a boat 1 is provided with a hull 10 and one outboard motor 20. The outboard motor 20 is preferably mounted on a stern 11 of the hull 10.

Schematic Configuration of the Outboard Motor

The outboard motor 20 is provided with an outboard motor main body 21, a tilt/trim mechanism 22, and a bracket 23.

The bracket 23 is provided with a mount bracket 24 and a swivel bracket 25. The mount bracket 24 is fixed on the hull 10. The swivel bracket 25 is swingable around a pivot shaft 26 with respect to the mount bracket 24.

The tilt/trim mechanism 22 operates to tilt and trim the outboard motor main body 21. Specifically, the tilt/trim mechanism 22 operates to swing the swivel bracket 25 with respect to the mount bracket 24.

The outboard motor main body 21 is provided with a casing 27, a cowling 28, and a propulsive force generation device 29. The propulsive force generation device 29 is disposed in the casing 27 and the cowling 28 excluding a portion of a propulsion unit 33 described below.

Figure 3:
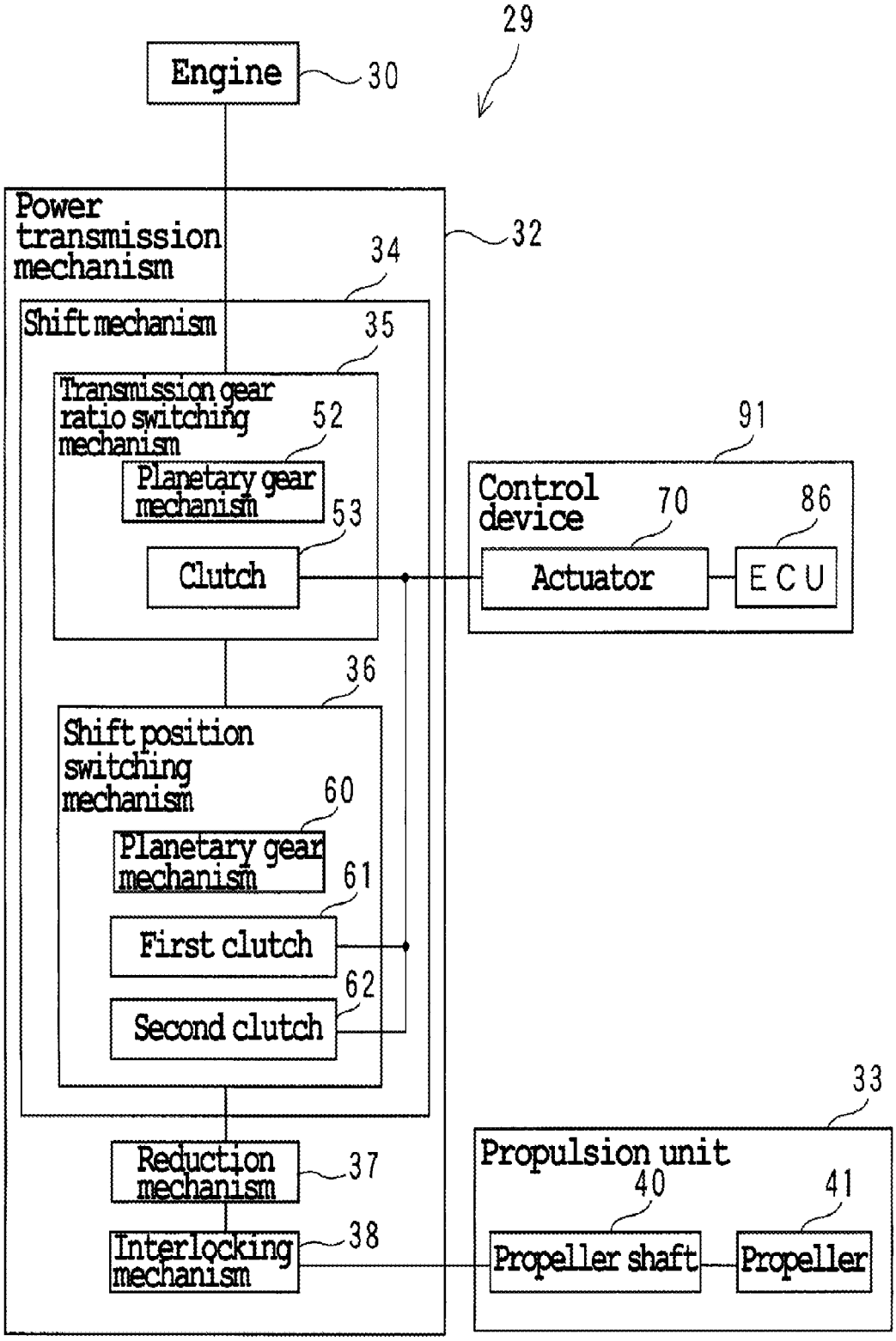
FIG. 3 is a schematic structure diagram showing a structure of a propulsive force generation device in the first preferred embodiment of the present invention.

As shown in FIG. 2 and FIG. 3, the propulsive force generation device 29 is provided with an engine 30, a power transmission mechanism 32, and the propulsion unit 33.

In this preferred embodiment, the outboard motor 20 has the engine 30 as a power source. However, the power source is not specifically limited as long as it can generate rotational force. For example, the power source may be an electric motor.

Figure 6:
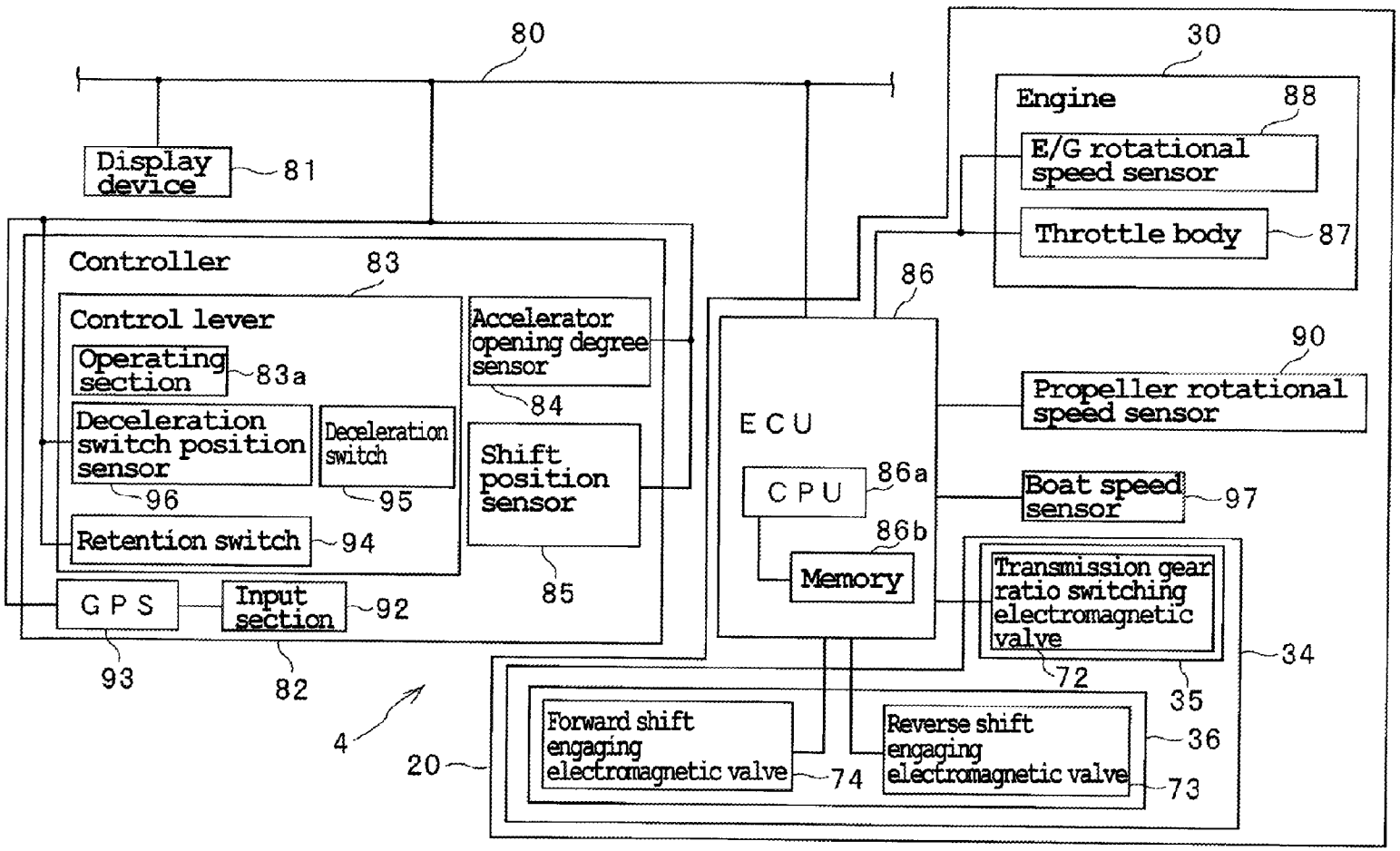
FIG. 6 is a control block diagram of the boat in the first preferred embodiment of the present invention.

The engine 30 is preferably a fuel injection engine that has a throttle body 87 shown in FIG. 6, for example. In the engine 30, a throttle opening degree is adjusted to adjust engine rotational speed and engine output. The engine 30 generates rotational force. As shown in FIG. 2, the engine 30 is provided with a crankshaft 31. The engine 30 outputs the generated rotational force via the crankshaft 31.

The power transmission mechanism 32 is disposed between the engine 30 and the propulsion unit 33. The power transmission mechanism 32 transmits the rotational force generated by the engine 30 to the propulsion unit 33. As shown in FIG. 3, the power transmission mechanism 32 is provided with a shift mechanism 34, a reduction mechanism 37, and an interlocking mechanism 38.

As shown in FIG. 2, a transmission gear ratio switching mechanism 35 and a shift position switching mechanism 36 are connected to the crankshaft 31 of the engine 30. As shown in FIG. 3, the shift mechanism 34 includes the transmission gear ratio switching mechanism 35 and the shift position switching mechanism 36.

The transmission gear ratio switching mechanism 35 switches a transmission gear ratio between the engine 30 and the propulsion unit 33 between a high-speed transmission gear ratio (HIGH) and a low-speed transmission gear ratio (LOW). Here, with the "high-speed transmission gear ratio", ratio of an output side rotational speed to an input side rotational speed is relatively low. On the other hand, with "low-speed gear ratio", the ratio of the output side rotational speed to the input side rotational speed is relatively high.

The shift position switching mechanism 36 switches a shift position among forward, reverse, and neutral.

The reduction mechanism 37 is disposed between the shift mechanism 34 and the propulsion unit 33. The reduction mechanism 37 reduces and transmits rotational force from the shift mechanism 34 to the propulsion unit 33 side. The structure of the reduction mechanism 37 is not specifically limited. For example, the reduction mechanism 37 may have a planetary gear mechanism. Alternatively, the reduction mechanism 37 may have a reduction gear pair.

The interlocking mechanism 38 is disposed between the reduction mechanism 37 and the propulsion unit 33. The interlocking mechanism 38 is preferably provided with a bevel gear set (not shown). The interlocking mechanism 38 changes a direction of and transmits rotational force from the reduction mechanism 37 to the propulsion unit 33.

The propulsion unit 33 is provided with a propeller shaft 40 and a propeller 41. The propeller shaft 40 transmits rotational force from the interlocking mechanism 38 to the propeller 41. The propulsion unit 33 converts rotational force generated by the engine 30 into propulsive force.

As shown in FIG. 2, the propeller 41 includes two propellers, namely a first propeller 41*a* and a second propeller 41*b*. A spiraling direction of the first propeller 41*a* and a spiraling direction of the second propeller 41*b* are opposite to each other. When the power transmission mechanism 32 outputs rotational force in the forward rotation direction, the first propeller 41*a* and the second propeller 41*b* rotate in directions opposite to each other to generate propulsive force in the forward direction. Consequently, the shift position is forward. On the other hand, when the power transmission mechanism 32 outputs rotational force in the reverse rotation direction, each of the first propeller 41*a* and the second propeller 41*b* rotates in a direction opposite to the direction at the time when propulsive force in the forward direction is generated. This generates propulsive force in the reverse direction. Consequently, the shift position is reverse.

The propeller 41 may be a single propeller or three or more propellers, for example.

Detailed Structure of the Shift Mechanism

Figure 4:
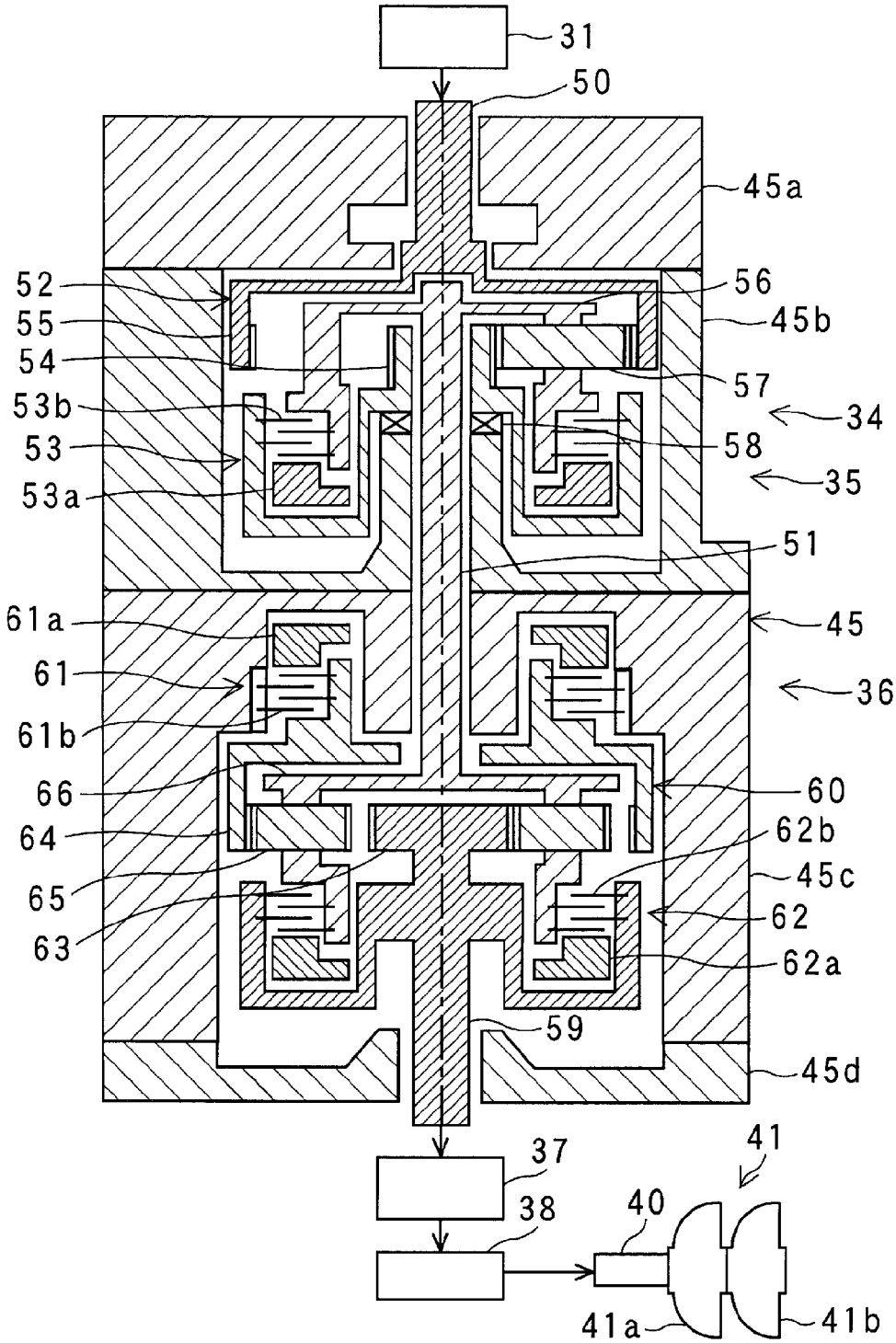
FIG. 4 is a schematic cross-sectional view of a shift mechanism in the first preferred embodiment of the present invention.

The structure of the shift mechanism 34 in this preferred embodiment will be described in detail mainly with reference to FIG. 4. FIG. 4 shows the shift mechanism 34 schematically, and therefore the structure of the shift mechanism 34 shown in FIG. 4 does not strictly agree with the structure of the actual shift mechanism 34.

The shift mechanism 34 is provided with a shift case 45. The shift case 45 preferably has a substantially cylindrical shape in external appearance. The shift case 45 is preferably provided with a first case 45*a*, a second case 45*b*, a third case 45*c*, and a fourth case 45*d*. The first case 45*a*, the second case 45*b*, the third case 45*c*, and the fourth case 45*d* are preferably integrally fixed by a bolt or other fastening or fixing element or material.

Transmission Gear Ratio Switching Mechanism

The transmission gear ratio switching mechanism 35 is provided with a first power transmission shaft 50 as an input shaft, a second power transmission shaft 51 as an output shaft, and a planetary gear mechanism 52 as a shift gear group, and a transmission gear ratio switching hydraulic clutch 53.

The planetary gear mechanism 52 transmits rotation of the first power transmission shaft 50 to the second power transmission shaft 51 with the low-speed transmission gear ratio (LOW) or the high-speed transmission gear ratio (HIGH). The transmission gear ratio of the planetary gear mechanism 52 is switched by engaging and disengaging the transmission gear ratio switching hydraulic clutch 53.

The first power transmission shaft 50 and the second power transmission shaft 51 are coaxially, or substantially coaxially, disposed. The first power transmission shaft 50 is rotatably supported by the first case 45*a*. The second power transmission shaft 51 is rotatably supported by the second case 45*b* and the third case 45*c*. The first power transmission shaft 50 is connected to the crankshaft 31. Further, the first power transmission shaft 50 is connected to the planetary gear mechanism 52.

The planetary gear mechanism 52 is provided with a sun gear 54, a ring gear 55, a carrier 56, and a plurality of planetary gears 57. The ring gear 55 preferably has a substantially cylindrical shape. The ring gear 55 has cogs, arranged on an inner circumference thereof, that mesh with the planetary gears 57. The ring gear 55 is connected to the first power transmission shaft 50. The ring gear 55 rotates together with the first power transmission shaft 50.

The sun gear 54 is disposed in the ring gear 55. The sun gear 54 and the ring gear 55 coaxially rotate. The sun gear 54 is attached on the second case 45*b* via a one-way clutch 58. The one-way clutch 58 allows rotation in the forward rotation direction, but restricts rotation in the reverse direction. Therefore, the sun gear 54 can rotate in the forward rotation direction, but cannot rotate in the reverse direction.

The plurality of the planetary gears 57 are disposed between the sun gear 54 and the ring gear 55. Each of the planetary gears 57 meshes with both the sun gear 54 and the ring gear 55. Each of the planetary gears 57 is rotatably supported by the carrier 56. Consequently, the plurality of planetary gears 57 revolve around an axis of the first power transmission shaft 50 at the same speed as each other while rotating around their own shaft.

In this description, the term "rotate" means that a member turns around a shaft located inside the member. On the other hand, the term "revolve" means that a member turns around a shaft located outside the member.

The carrier 56 is connected to the second power transmission shaft 51. The carrier 56 rotates together with the second power transmission shaft 51.

The transmission gear ratio switching hydraulic clutch 53 is disposed between the carrier 56 and the sun gear 54. In this preferred embodiment, the transmission gear ratio switching hydraulic clutch 53 is preferably a wet-type multi-plate clutch. However, the transmission gear ratio switching hydraulic clutch 53 is not limited to a wet-type multi-plate clutch. The transmission gear ratio switching hydraulic clutch 53 may also be a dry-type multi-plate clutch or a so-called dog clutch.

In this description, the "multi-plate clutch" refers to a clutch provided with a first member and a second member rotatable relative to each other, a first plate or a plurality of first plates that rotates or rotate together with the first member, and a second plate or a plurality of second plates that rotates or rotate together with the second member, in which rotation between the first member and the second member is regulated by pressing the first plate and the second plate against each other. In this specification, the "clutch" is not limited to a clutch that is disposed between an input shaft which receives rotational force and an output shaft which outputs rotational force and that engages and disengages the input shaft and the output shaft.

The transmission gear ratio switching hydraulic clutch 53 is provided with a hydraulic cylinder 53*a* and a plate group 53*b* including a clutch plate and a friction plate. As the hydraulic cylinder 53*a* is activated, the plate group 53*b* is compressed. Consequently, the transmission gear ratio switching hydraulic clutch 53 becomes engaged. On the other hand, when the hydraulic cylinder 53*a* is deactivated, the plate group 53*b* is decompressed. Consequently, the transmission gear ratio switching hydraulic clutch 53 becomes disengaged.

When the transmission gear ratio switching hydraulic clutch 53 becomes engaged, the sun gear 54 and the carrier 56 become fixed to each other. Consequently, the sun gear 54 and the carrier 56 integrally rotate as the planetary gears 57 revolve.

Shift Position Switching Mechanism

The shift position switching mechanism 36 switches between forward, reverse, and neutral. The shift position switching mechanism 36 is provided with the second power transmission shaft 51 as an input shaft, a third power transmission shaft 59 as an output shaft, a planetary gear mechanism 60 as a rotation direction switching mechanism, a first shift position switching hydraulic clutch 61, and a second shift position switching hydraulic clutch 62.

The first shift position switching hydraulic clutch 61 and the second shift position switching hydraulic clutch 62 engage and disengage the second power transmission shaft 51 as the input shaft and the third power transmission shaft 59 as the output shaft. Specifically, as the first shift position switching hydraulic clutch 61 and the second shift position switching hydraulic clutch 62 are engaged and disengaged, a connection state between the second power transmission shaft 51 and the third power transmission shaft 59 changes. In other words, the first shift position switching hydraulic clutch 61 and the second shift position switching hydraulic clutch 62 change the connection state between the second power transmission shaft 51 and the third power transmission shaft 59. Specifically, as engagement force of the first shift position switching hydraulic clutch 61 and the second shift position switching hydraulic clutch 62 is adjusted, rotational speed of the third power transmission shaft 59 is adjusted with respect to rotational speed of the second power transmission shaft 51. More specifically, as the engagement force of the first shift position switching hydraulic clutch 61 and the second shift position switching hydraulic clutch 62 is adjusted, a rotation direction of the third power transmission shaft 59 is adjusted with respect to a rotation direction of the second power transmission shaft 51, and ratio of an absolute value of the rotational speed of the third power transmission shaft 59 is adjusted with respect to an absolute value of the rotational speed of the second power transmission shaft 51.

The planetary gear mechanism 52 switches the rotation direction of the third power transmission shaft 59 with respect to the rotation direction of the second power transmission shaft 51. Specifically, the planetary gear mechanism 52 transmits rotational force of the second power transmission shaft 51 to the third power transmission shaft 59 as rotational force in the forward rotation direction or in the reverse rotation direction. A rotation direction of the rotational force transmitted by the planetary gear mechanism 52 is switched by engaging and disengaging the first shift position switching hydraulic clutch 61 and the second shift position switching hydraulic clutch 62.

The third power transmission shaft 59 is rotatably supported by the third case 45*c* and the fourth case 45*d*. The second power transmission shaft 51 and the third power transmission shaft 59 are coaxially disposed. In this preferred embodiment, the shift position switching hydraulic clutches 61, 62 are preferably wet-type multi-plate clutches. However, the shift position switching hydraulic clutches 61, 62 may also be dog clutches.

The second power transmission shaft 51 is shared by the transmission gear ratio switching mechanism 35 and the shift position switching mechanism 36.

The planetary gear mechanism 60 is provided with a sun gear 63, a ring gear 64, a plurality of planetary gears 65, and a carrier 66.

The carrier 66 is connected to the second power transmission shaft 51. The carrier 66 rotates together with the second power transmission shaft 51. Consequently, as the second power transmission shaft 51 rotates, the carrier 66 rotates. At the same time, the plurality of planetary gears 65 revolve at the same speed as each other.

A plurality of the planetary gears 65 mesh with the ring gear 64 and the sun gear 63. The first shift position switching hydraulic clutch 61 is disposed between the ring gear 64 and the third case 45*c*. The first shift position switching hydraulic clutch 61 is provided with a hydraulic cylinder 61*a* and a plate group 61*b* that includes a clutch plate and a friction plate. As the hydraulic cylinder 61*a* is activated, the plate group 61*b* is compressed. Consequently, the first shift position switching hydraulic clutch 61 becomes engaged. As a result, the ring gear 64 becomes fixed with respect to the third case 45*c* and is thus unrotatable. On the other hand, when the hydraulic cylinder 61*a* is deactivated, the plate group 61*b* is decompressed. Consequently, the first shift position switching hydraulic clutch 61 becomes disengaged. As a result, the ring gear 64 becomes unfixed with respect to the third case 45*c* and thus rotatable.

The second shift position switching hydraulic clutch 62 is disposed between the carrier 66 and the sun gear 63. The second shift position switching hydraulic clutch 62 is provided with a hydraulic cylinder 62*a* and a plate group 62*b* that includes a clutch plate and a friction plate. As the hydraulic cylinder 62*a* is activated, the plate group 62*b* is compressed. Consequently, the second shift position switching hydraulic clutch 62 becomes engaged. As a result, the carrier 66 and the sun gear 63 integrally rotate. On the other hand, when the hydraulic cylinder 62*a* is deactivated, the plate group 62*b* is decompressed. Consequently, the second shift position switching hydraulic clutch 62 becomes disengaged. As a result, the ring gear 64 and the sun gear 63 become rotatable relative to each other.

The reduction gear ratio of the planetary gear mechanism 60 is not limited to 1:1. The planetary gear mechanism 60 may have a reduction gear ratio that is different from 1:1. Furthermore, the reduction gear ratio of the planetary gear mechanism 60 may be the same or may be different between the case that the planetary gear mechanism 60 transmits rotational force as a rotation in the forward rotation direction and the case that the planetary gear mechanism 60 transmits the rotational force as a rotation in the reverse rotation direction.

In this preferred embodiment, it is assumed that the reduction gear ratio of the planetary gear mechanism 60 is different from 1:1 and different between the case that the planetary gear mechanism 60 transmits the rotational force as rotation in the forward rotation direction and the case that the planetary gear mechanism 60 transmits the rotational force as rotation in the reverse rotation direction.

Specifically, in this preferred embodiment, a ratio between rotational speed of the first power transmission shaft 50 and rotational speed of the third power transmission shaft 59 is preferably as follows.

High-speed forward: 1:1, reduction gear ratio 1

High-speed reverse: 1:1.08, reduction gear ratio 0.93

Low-speed forward: 1:0.77, reduction gear ratio 1.3

Low-speed reverse: 1:0.83, reduction gear ratio 1.21

As shown in FIG. 3, the shift mechanism 34 is controlled by a control device 91. Specifically, the control device 91 is arranged to control the engagement and disengagement of the transmission gear ratio switching hydraulic clutch 53, the first shift position switching hydraulic clutch 61, and the second shift position switching hydraulic clutch 62.

The control device 91 is provided with an actuator 70 and an electronic control unit (ECU) 86 as a control section. The actuator 70 engages and disengages the transmission gear ratio switching hydraulic clutch 53, the first shift position switching hydraulic clutch 61, and the second shift position switching hydraulic clutch 62. The ECU 86 controls the actuator 70.

Figure 5:
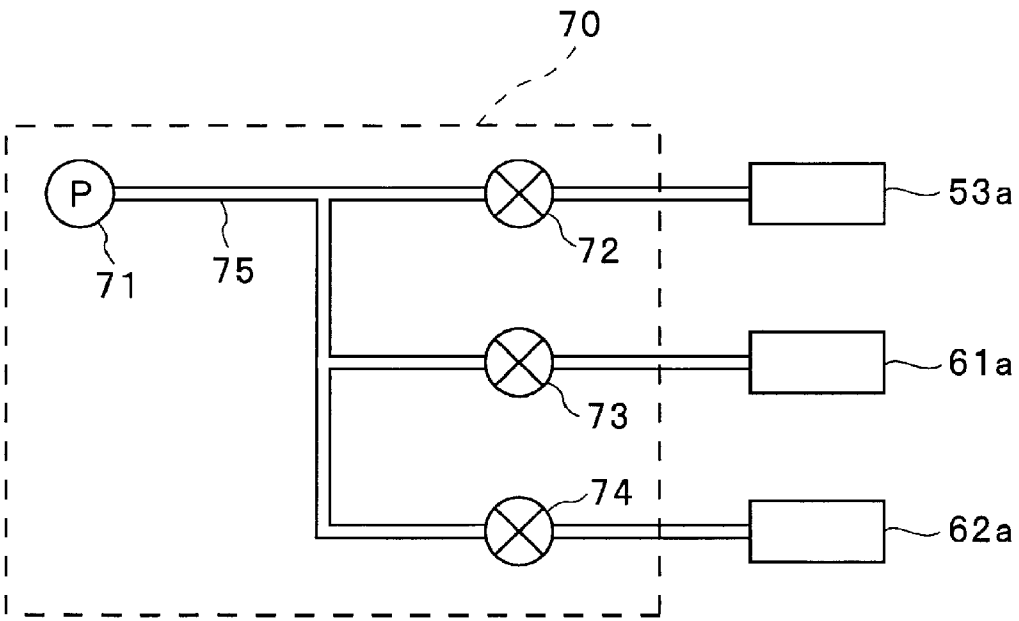
FIG. 5 is an oil circuit diagram in the first preferred embodiment of the present invention.

Specifically, as shown in FIG. 5, the hydraulic cylinders 53*a*, 61*a*, and 62*a* are activated by the actuator 70. The actuator 70 is preferably provided with an oil pump 71, an oil path 75, a transmission gear ratio switching electromagnetic valve 72, a reverse shift engaging electromagnetic valve 73, and a forward shift engaging electromagnetic valve 74.

The oil pump 71 is connected to the hydraulic cylinders 53*a*, 61*a*, and 62*a* by the oil path 75. The transmission gear ratio switching electromagnetic valve 72 is disposed between the oil pump 71 and the hydraulic cylinder 53*a*. Hydraulic pressure of the hydraulic cylinder 53*a* is adjusted by the transmission gear ratio switching electromagnetic valve 72. The reverse shift engaging electromagnetic valve 73 is disposed between the oil pump 71 and the hydraulic cylinder 61*a*. Hydraulic pressure of the hydraulic cylinder 61*a* is adjusted by the reverse shift engaging electromagnetic valve 73. The forward shift engaging electromagnetic valve 74 is disposed between the oil pump 71 and the hydraulic cylinder 62*a*. Hydraulic pressure of the hydraulic cylinder 62*a* is adjusted by the forward shift engaging electromagnetic valve 74.

Each of the transmission gear ratio switching electromagnetic valve 72, the reverse shift engaging electromagnetic valve 73, and the forward shift engaging electromagnetic valve 74 can gradually change a path area of the oil path 75. Consequently, the transmission gear ratio switching electromagnetic valve 72, the reverse shift engaging electromagnetic valve 73, and the forward shift engaging electromagnetic valve 74 can be used to gradually change a pressing force of the hydraulic cylinders 53*a*, 61*a*, and 62*a*. Therefore, it is possible to gradually change an engagement force of the hydraulic clutches 53, 61, and 62. Consequently, as shown in FIG. 7, ratio of the third power transmission shaft 59 with respect to the rotational speed of the second power transmission shaft 51 can be adjusted. As a result, the ratio of the third power transmission shaft 59 as the output shaft with respect to the rotational speed of the second power transmission shaft 51 as the input shaft can be substantially continuously adjusted.

In this preferred embodiment, each of the transmission gear ratio switching electromagnetic valve 72, the reverse shift engaging electromagnetic valve 73, and the forward shift engaging electromagnetic valve 74 is preferably defined by a solenoid valve that is controlled by pulse width modulation (PWM). However, each of the transmission gear ratio switching electromagnetic valve 72, the reverse shift engaging electromagnetic valve 73, and the forward shift engaging electromagnetic valve 74 may be defined by a valve other than a solenoid valve that is controlled by PWM. For example, each of the transmission gear ratio switching electromagnetic valve 72, the reverse shift engaging electromagnetic valve 73, and the forward shift engaging electromagnetic valve 74 may be defined by a solenoid valve that is on-off controlled.

Shift Change Operation of the Shift Mechanism 34

A shift change operation of the shift mechanism 34 will be described hereinafter in detail mainly with reference to FIG. 4 and FIG. 7. FIG. 7 shows a table showing engagement states of the hydraulic clutches 53, 61, and 62 and shift positions of the shift mechanism 34. A shift position of the shift mechanism 34 is switched by engagement and disengagement of the first to third hydraulic clutches 53, 61, and 62.

Switching Between the Low-Speed Transmission Gear Ratio and the High-Speed Transmission Gear Ratio Switching of the low-speed transmission gear ratio and the high-speed transmission gear ratio is performed by the transmission gear ratio switching mechanism 35. Specifically, the low-speed transmission gear ratio and the high-speed transmission gear ratio are switched by an operation of the transmission gear ratio switching hydraulic clutch 53. In detail, when the transmission gear ratio switching hydraulic clutch 53 is disengaged, a transmission gear ratio of the transmission gear ratio switching mechanism 35 becomes the "low-speed transmission gear ratio." On the other hand, when the transmission gear ratio switching hydraulic clutch 53 is engaged, the transmission gear ratio of the transmission gear ratio switching mechanism 35 becomes the "high-speed transmission gear ratio."

As shown in FIG. 4, the ring gear 55 is connected to the first power transmission shaft 50. Consequently, as the first power transmission shaft 50 rotates, the ring gear 55 rotates in the forward rotation direction. Here, when the transmission gear ratio switching hydraulic clutch 53 is disengaged, the carrier 56 and the sun gear 54 are rotatable relative to each other. Consequently, the planetary gears 57 rotate and revolve at the same time. As a result, the sun gear 54 is going to rotate in the reverse rotation direction.

However, as shown in FIG. 7, the one-way clutch 58 prevents the sun gear 54 from rotating in the reverse rotation direction. Consequently, the sun gear 54 is fixed by the one-way clutch 58. As a result, as the ring gear 55 rotates, the planetary gears 57 revolve between the sun gear 54 and the ring gear 55. Consequently, the second power transmission shaft 51 rotates together with the carrier 56. In this case, as the planetary gears 57 revolve and rotate at the same time, the rotation of the first power transmission shaft 50 is decelerated and transmitted to the second power transmission shaft 51. Therefore, the transmission gear ratio of the transmission gear ratio switching mechanism 35 becomes the "low-speed transmission gear ratio."

On the other hand, when the transmission gear ratio switching hydraulic clutch 53 is engaged, the planetary gears 57 and the sun gear 54 integrally rotate. Consequently, rotation of the planetary gears 57 is prohibited. Therefore, as the ring gear 55 rotates, the planetary gears 57, the carrier 56, and the sun gear 54 rotate at the same rotational speed as the ring gear 55 in the forward rotation direction. Here, as shown in FIG. 7, the one-way clutch 58 allows forward rotation of the sun gear 54. As a result, the first power transmission shaft 50 and the second power transmission shaft 51 rotate at substantially the same rotational speed in the forward rotation direction. In other words, rotational force of the first power transmission shaft 50 is transmitted to the second power transmission shaft 51 at the same rotational speed and in the same rotation direction. Therefore, the transmission gear ratio of the transmission gear ratio switching mechanism 35 becomes the "high-speed transmission gear ratio."

Switching Between Forward, Reverse, and Neutral

The shift position switching mechanism 36 switches between forward, reverse, and neutral. Specifically, forward, reverse, and neutral are switched by an operation of the first shift position switching hydraulic clutch 61 and the second shift position switching hydraulic clutch 62 shown in FIG. 4.

As shown in FIG. 7, when the first shift position switching hydraulic clutch 61 is disengaged and the second shift position switching hydraulic clutch 62 is engaged, the shift position of the shift position switching mechanism 36 becomes "forward." When the first shift position switching hydraulic clutch 61 shown in FIG. 4 is disengaged, the ring gear 64 is rotatable with respect to the shift case 45. When the second shift position switching hydraulic clutch 62 is engaged, the carrier 66 and the sun gear 63 and the third power transmission shaft 59 rotate integrally. Consequently, when the first shift position switching hydraulic clutch 61 is engaged and the second shift position switching hydraulic clutch 62 is engaged, the second power transmission shaft 51, the carrier 66, the sun gear 63, and the third power transmission shaft 59 integrally rotate in the forward rotation direction. Therefore, the shift position of the shift position switching mechanism 36 becomes "forward."

As shown in FIG. 7, when the first shift position switching hydraulic clutch 61 is engaged and the second shift position switching hydraulic clutch 62 is disengaged, the shift position of the shift position switching mechanism 36 becomes "reverse." While the first shift position switching hydraulic clutch 61 shown in FIG. 4 is engaged and the second shift position switching hydraulic clutch 62 is disengaged, the rotation of the ring gear 64 is regulated by the shift case 45. On the other hand, the sun gear 63 becomes rotatable with respect to the carrier 66. Therefore, as the second power transmission shaft 51 rotates in the forward rotation direction, the planetary gears 65 rotate and revolve. As a result, the sun gear 63 and the third power transmission shaft 59 rotate in the reverse rotation direction. Therefore, the shift position of the shift position switching mechanism 36 becomes "reverse."

Further, as shown in FIG. 7, when both of the first shift position switching hydraulic clutch 61 and the second shift position switching hydraulic clutch 62 are disengaged, the shift position of the shift position switching mechanism 36 becomes "neutral." When both of the first shift position switching hydraulic clutch 61 and the second shift position switching hydraulic clutch 62 shown in FIG. 4 are disengaged, the planetary gear mechanism 60 is in an idling state. Consequently, rotation of the second power transmission shaft 51 is not transmitted to the third power transmission shaft 59. Therefore, the shift position of the shift position switching mechanism 36 becomes "neutral."

As described above, the low-speed transmission gear ratio and the high-speed transmission gear ratio are switched, and the shift position is switched. Therefore, as shown in FIG. 7, when the transmission gear ratio switching hydraulic clutch 53 and the first shift position switching hydraulic clutch 61 are disengaged and the second shift position switching hydraulic clutch 62 is engaged, the shift position of the shift mechanism 34 becomes "low-speed forward."

When the transmission gear ratio switching hydraulic clutch 53 and the second shift position switching hydraulic clutch 62 are engaged and the first shift position switching hydraulic clutch 61 is disengaged, the shift position of the shift mechanism 34 becomes "high-speed forward."

When both of the first shift position switching hydraulic clutch 61 and the second shift position switching hydraulic clutch 62 are disengaged, the shift position of the shift mechanism 34 becomes "neutral" regardless of the engagement state of the transmission gear ratio switching hydraulic clutch 53.

When the transmission gear ratio switching hydraulic clutch 53 and the second shift position switching hydraulic clutch 62 are disengaged and the first shift position switching hydraulic clutch 61 is engaged, the shift position of the shift mechanism 34 becomes "low-speed reverse."

Furthermore, when the transmission gear ratio switching hydraulic clutch 53 and the first shift position switching hydraulic clutch 61 are engaged and the second shift position switching hydraulic clutch 62 is disengaged, the shift position of the shift mechanism 34 becomes "high-speed reverse."

Control Block of the Boat

A control block of the boat 1 will be described hereinafter mainly with reference to FIG. 6.

The control block of the outboard motor 20 will be described first with reference to FIG. 6. The ECU 86 is disposed as a control section in the outboard motor 20. The ECU 86 constitutes a portion of the control device 91 illustrated in FIG. 3. Each mechanism of the outboard motor 20 is controlled by the ECU 86.

The ECU 86 is provided with a central processing unit (CPU) 86*a* as an operation portion and a memory 86*b*. Various settings are stored in the memory 86*b* such as in a map described below. The memory 86*b* is connected to the CPU 86*a*. The CPU 86*a* reads out necessary information stored in the memory 86*b* to perform various calculations. Further, the CPU 86*a* outputs a calculation result to the memory 86*b* as necessary to make the memory 86*b* store the calculation result and so forth.

The throttle body 87 of the engine 30 is connected to the ECU 86. The throttle body 87 is controlled by the ECU 86. Consequently, a throttle opening degree of the engine 30 is controlled. Specifically, the throttle opening degree of the engine 30 is controlled based on an operation amount of a control lever 83 and a sensibility switch signal. As a result, an output of the engine 30 is controlled.

Further, an engine rotational speed sensor 88 is preferably connected to the ECU 86. The engine rotational speed sensor 88 detects rotational speed of the crankshaft 31 of the engine 30 shown in FIG. 2. The engine rotational speed sensor 88 outputs the detected engine rotational speed to the ECU 86.

A boat speed sensor 97 is preferably connected to the ECU 86. The boat speed sensor 97 detects propulsion speed of the boat 1. The boat speed sensor 97 outputs the detected propulsion speed of the boat 1 to the ECU 86.

In this preferred embodiment, the boat speed sensor 97 is provided separately from a GPS 93. However, the present invention is not limited to the preferred embodiment above, and the GPS 93 may serve also as a boat speed sensor.

A propeller rotational speed sensor 90 is preferably disposed in the power transmission mechanism 32 shown in FIG. 3 on a side of the propeller 41 with respect to the second shift position switching hydraulic clutch 62. The propeller rotational speed sensor 90 detects rotational speed of the propeller 41 directly or indirectly. The propeller rotational speed sensor 90 outputs the detected rotational speed to the ECU 86. Specifically, the propeller rotational speed sensor 90 may detect rotational speed of the propeller 41, rotational speed of the propeller shaft 40, and rotational speed of the third power transmission shaft 59.

Further, the transmission gear ratio switching electromagnetic valve 72, the forward shift engaging electromagnetic valve 74, and the reverse shift engaging electromagnetic valve 73 are connected to the ECU 86. Opening and closing and an opening degree adjustment of the transmission gear ratio switching electromagnetic valve 72, the forward shift engaging electromagnetic valve 74, and the reverse shift engaging electromagnetic valve 73 are preferably controlled by the ECU 86.

As shown in FIG. 6, the boat 1 is provided with a local area network (LAN) 80. The LAN 80 spreads over the hull 10. Signals are sent and received via the LAN 80 arranged between devices in the boat 1.

The ECU 86 of the outboard motor 20, a controller 82, a display device 81, and so forth are connected to the LAN 80. The controller 82 defines a boat propulsion unit 4 together with the outboard motor 20 as a boat propulsion system. The display device 81 displays information output from the ECU 86 and information output from the controller 82 described below. Specifically, the display device 81 displays a current speed, a shift position, and so forth of the boat 1.

The controller 82 is provided with the control lever 83, an accelerator opening degree sensor 84, a shift position sensor 85, the global positioning system (GPS) 93 as a detection section, and an input section 92.

The GPS 93 constantly detects a position of the boat 1 to detect the position, movement, and so forth of the boat 1. The "movement of the boat" includes propulsion speed, moving distance, moving direction, and so forth of the boat. Information detected by the GPS 93 will be described hereinafter as "GPS information." The GPS 93 sends acquired GPS information to the ECU 86 and the display device 81 via the LAN 80.

The input section 92 is connected to the GPS 93. Various types of information are input to the input section 92 by an operator.

The control lever 83 is preferably provided with an operating section 83*a*, a deceleration switch 95, a deceleration switch position sensor 96, and a retention switch 94.

Figure 8:
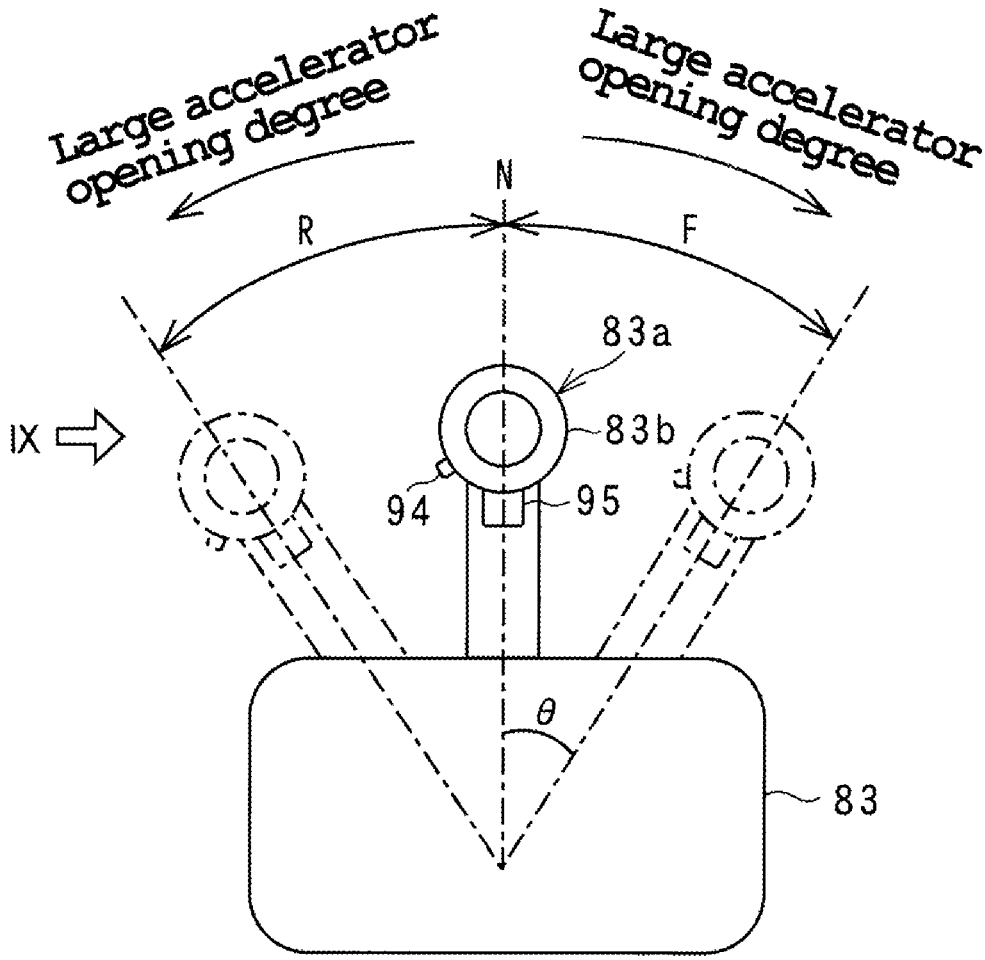
FIG. 8 is a schematic side view of a control lever.

A shift position and an accelerator opening degree are input to the operating section 83*a* by an operation of the operator of the boat 1. Specifically, as shown in FIG. 8, when the operator operates the operating section 83*a*, an accelerator opening degree and a shift position corresponding to a position of the operating section 83*a* are detected by the accelerator opening degree sensor 84 and the shift position sensor 85 respectively. Each of the accelerator opening degree sensor 84 and the shift position sensor 85 is connected to the LAN 80. The accelerator opening degree sensor 84 and shift position sensor 85 send an accelerator opening degree signal and a shift position signal to the LAN 80, respectively. The ECU 86 receives the accelerator opening degree signal and the shift position signal output from the accelerator opening degree sensor 84 and the shift position sensor 85 via the LAN 80.

Specifically, when the operating section 83*a* of the control lever 83 is located in a neutral position denoted by "N" in FIG.

8, the shift position sensor 85 outputs a shift position signal corresponding to neutral. When the operating section 83*a* is located in a forward area denoted by "F" in FIG. 8, the shift position sensor 85 outputs a shift position signal corresponding to forward. When the operating section 83*a* is located in a reverse area denoted by "R" in FIG. 8, the shift position sensor 85 outputs a shift position signal corresponding to reverse.

The accelerator opening degree sensor 84 detects an operation amount of the operating section 83*a*. Specifically, the accelerator opening degree sensor 84 detects operation angle θ that shows how much the operating section 83*a* is operated from a middle position. The operating section 83*a* outputs operation angle θ as an accelerator opening degree signal.

Figure 9:
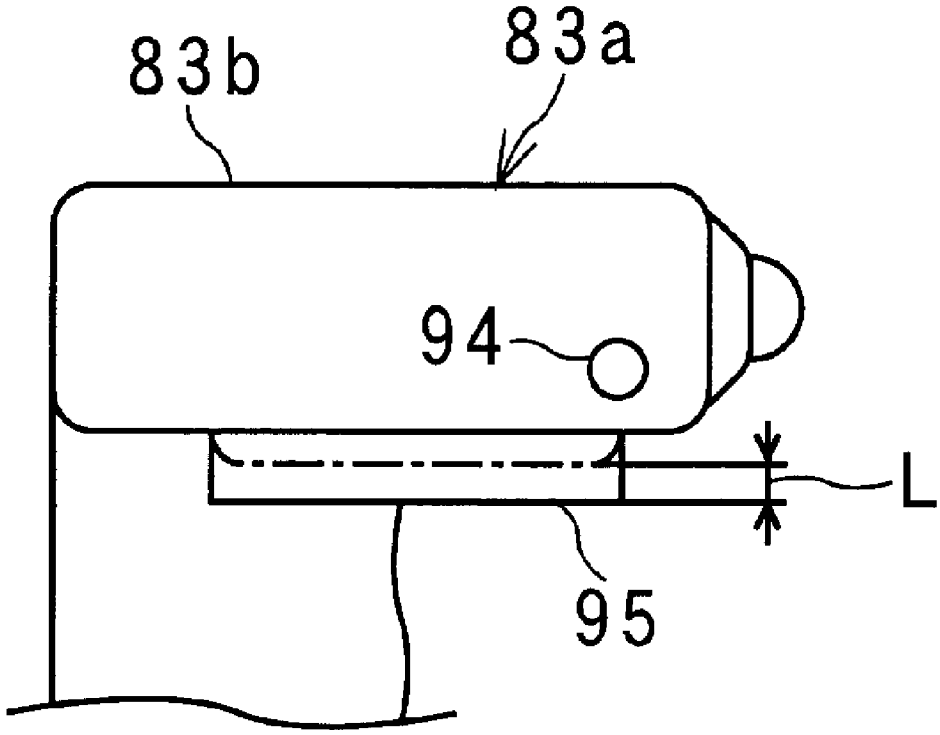
FIG. 9 is a view seen from a direction of arrow IX in FIG. 8.
Figure 10:
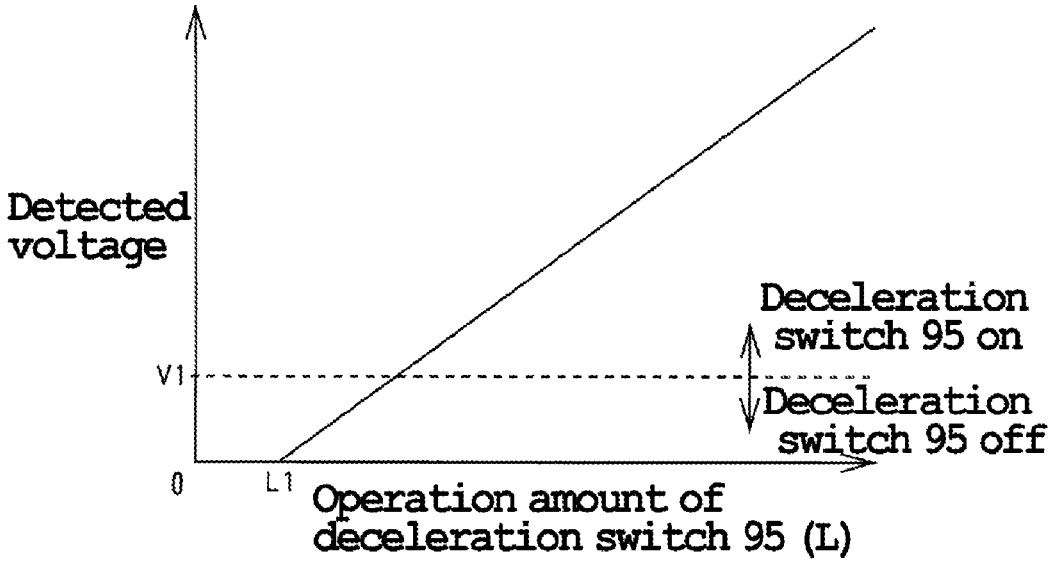
FIG. 10 is a graph showing relationship between operation amount of a deceleration switch and detected voltage of a deceleration switch position sensor.

As shown in FIG. 8 and FIG. 9, the deceleration switch 95 is disposed on a lower part of a grip 83*b* of the operating section 83*a* extending generally horizontally. The deceleration switch 95 is used to decelerate the boat 1. The deceleration switch position sensor 96 detects operation amount L of the deceleration switch 95 shown in FIG. 9. The deceleration switch position sensor 96 sends a deceleration signal having voltage corresponding to operation amount L of the deceleration switch 95 to the ECU 86 via the LAN 80. Specifically, as shown in FIG. 10, as operation amount L of the deceleration switch 95 becomes larger, the deceleration switch position sensor 96 sends a deceleration signal having higher voltage to the ECU 86 via the LAN 80. A so-called play is provided to the deceleration switch 95. Specifically, as shown in FIG. 10, before operation amount L of the deceleration switch 95 reaches predefined operation amount L1, the deceleration switch position sensor 96 does not detect an operation of the deceleration switch 95 and does not send a deceleration signal.

Figure 11:
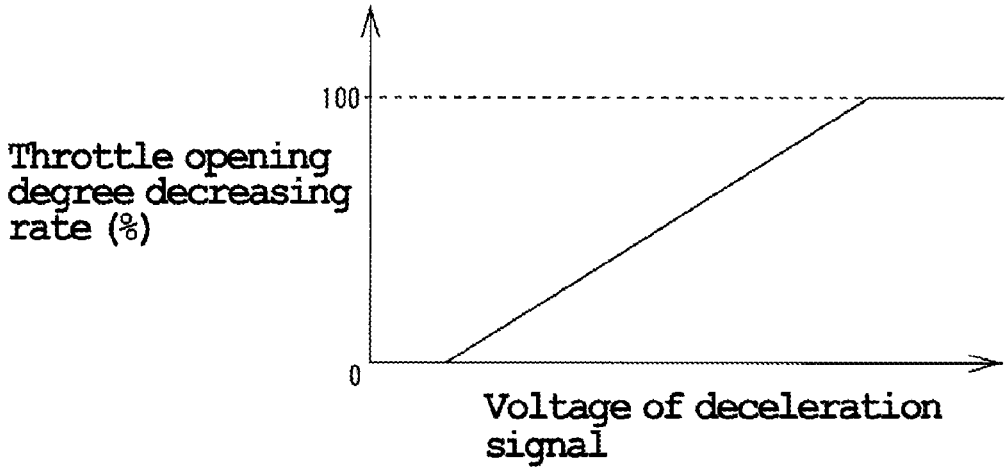
FIG. 11 is a graph showing voltage of deceleration signals and decreasing rate of throttle opening degrees.

When the deceleration switch 95 is operated by the operator, the ECU 86 controls the throttle opening degree based on a deceleration signal from the deceleration switch position sensor 96. Specifically, a map shown in FIG. 11 that regulates voltage of deceleration signals and throttle opening degree decreasing rate is stored in the memory 86*b*. The CPU 86*a* decreases a throttle opening degree based on this map. In detail, as operation amount L of the deceleration switch 95 becomes large, and as voltage of a deceleration signal from the deceleration switch position sensor 96 becomes large, the CPU 86*a* largely decreases the throttle opening degree. Consequently, the propulsive force of the boat 1 decreases. As a result, the propulsion speed of the boat 1 gradually decreases.

As shown in FIG. 8 and FIG. 9, the retention switch 94 is preferably disposed on a side of the grip 83*b*. The retention switch 94 is used to suppress a movement of the boat 1.

When the retention switch 94 is operated by the operator, a fixed point retention signal is sent from the retention switch 94 to the ECU 86 via the LAN 80. When the fixed point retention signal is received, the ECU 86 performs fixed point retention control described below in detail.

Control of the Boat

Control of the boat 1 will be described hereinafter.

Basic Control of the Boat

When the control lever 83 is operated by the operator of the boat 1, an accelerator opening degree and a shift position corresponding to an operation situation of the control lever 83 are detected by the accelerator opening degree sensor 84 and the shift position sensor 85. The detected accelerator opening degree and the shift position are sent to the LAN 80. The ECU 86 receives the accelerator opening degree signal and the shift position signal output via the LAN 80. The ECU 86 controls the throttle body 87 and the shift position switching hydraulic clutches 61 and 62 based on the accelerator opening degree signal and an accelerator opening degree obtained from the map shown in FIG. 11. Accordingly, the ECU 86 controls propeller rotational speed.

Further, the ECU 86 controls the shift mechanism 34 according to a shift position signal. Specifically, when a shift position signal of "low-speed forward" is received, the transmission gear ratio switching electromagnetic valve 72 is driven to disengage the transmission gear ratio switching hydraulic clutch 53. At the same time, the shift engaging electromagnetic valves 73 and 74 are driven to disengage the first shift position switching hydraulic clutch 61 and engage the second shift position switching hydraulic clutch 62. Consequently, a shift position is switched to "low-speed forward."

Specific Control of the Boat (1) Fixed Point Retention Control

In this preferred embodiment, when the retention switch 94 is turned on by the operator, the ECU 86 controls engagement force of the shift position switching hydraulic clutches 61 and 62 to retain the hull 10 in a predefined position. In this preferred embodiment, this control is called "fixed point retention control." Specifically, in this preferred embodiment, the ECU 86 controls an engagement force of the shift position switching hydraulic clutches 61 and 62 to retain the hull 10 in a position of the hull 10 at the time when the retention switch 94 is turned on by the operator.

The fixed point retention control in this preferred embodiment will be described hereinafter in detail with reference to FIG. 12 to FIG. 14.

Figure 12:
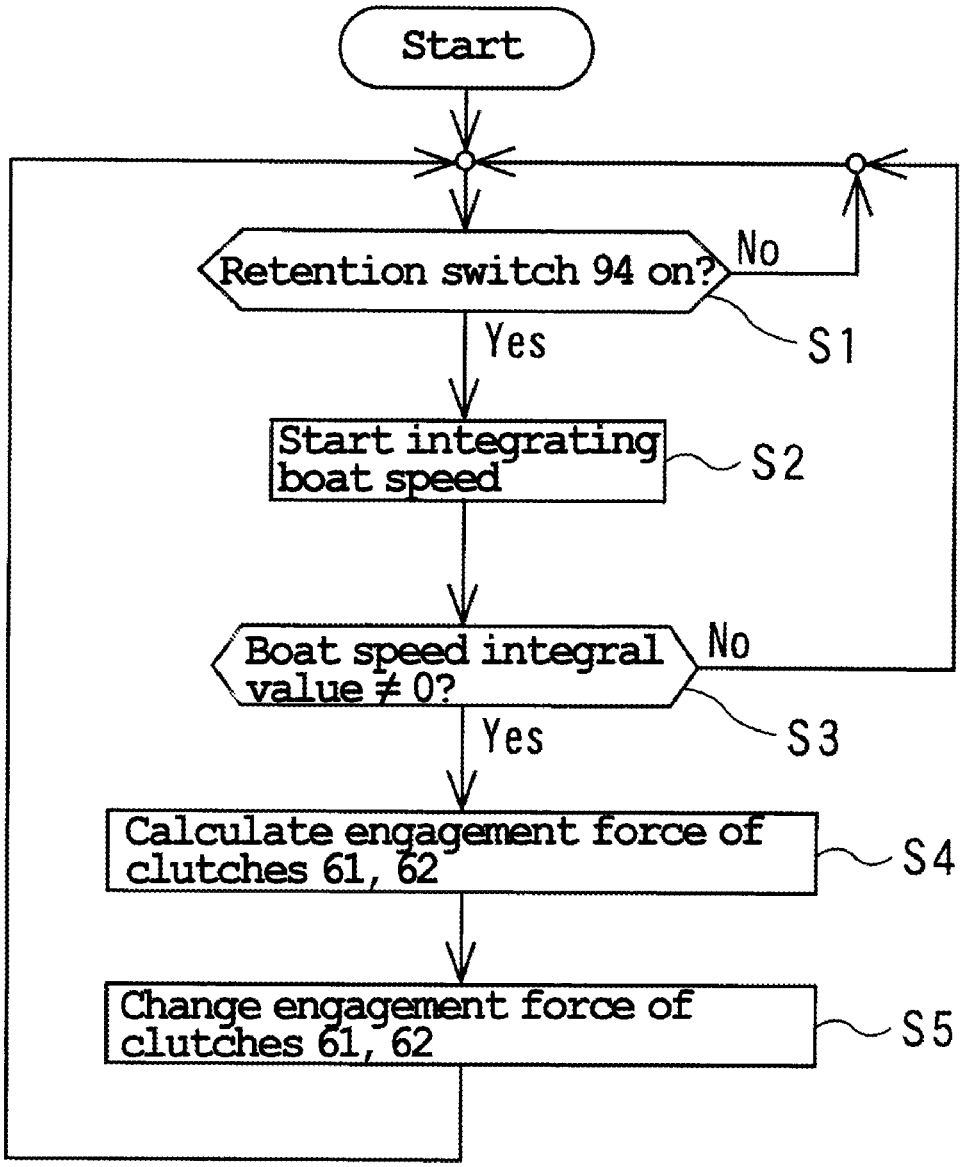
FIG. 12 is a flow chart showing fixed point retention control for the boat in the first preferred embodiment of the present invention.
Figure 13:
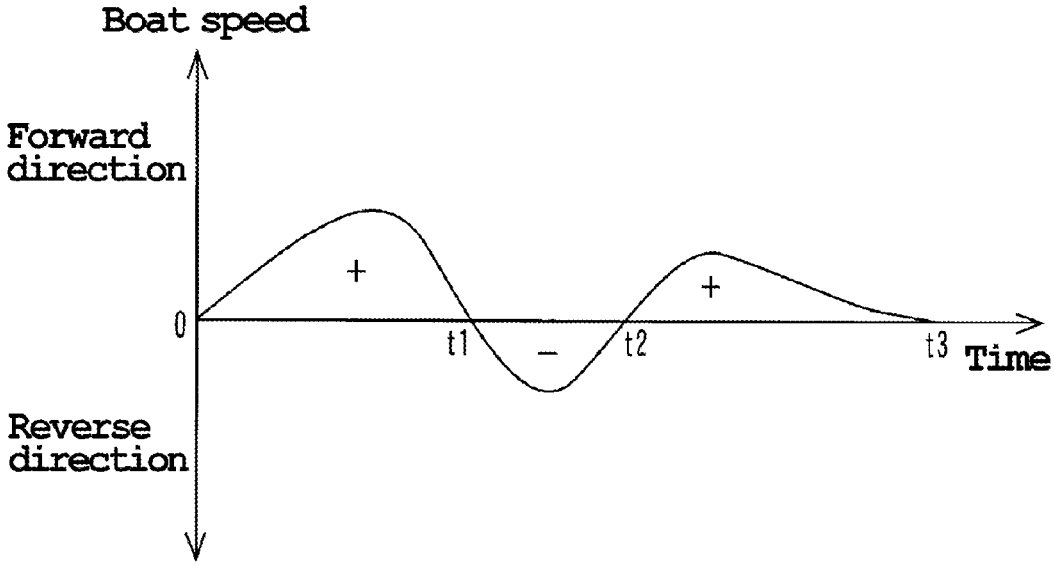
FIG. 13 is a graph showing boat speed integral values, where the horizontal axis represents time and the vertical axis represents boat speed.

As shown in FIG. 12, first, the ECU 86 determines whether or not the retention switch 94 is on in step S1. In step S1, if it is determined that the retention switch 94 is off, the process returns to step S1.

On the other hand, if it is determined that the retention switch 94 is on in step S1, the process proceeds to step S2. In step S2, the ECU 86 starts an integration of boat speed. Specifically, the ECU 86 acquires boat speed as propulsion speed of the boat 1 from a boat speed sensor 47 in step S2. The ECU 86 integrates the acquired boat speed with respect to time to calculate a boat speed integral value. As shown in FIG. 13, when a propulsion direction of the boat 1 is in the forward direction, the boat speed integral value is calculated as a positive value. On the other hand, when the propulsion direction of the boat 1 is in the reverse direction, the boat speed integral value is calculated as a negative value.

Following step S2, step S3 is performed. In step S3, the ECU 86 determines whether or not the boat speed integral value is 0. If the boat speed integral value is determined to be 0 in step S3, the process returns to step S1.

On the other hand, if it is determined in step S3 that the boat speed integral value is not 0, the process proceeds to step S4. In step S4, the ECU 86 calculates engagement force of the shift position switching hydraulic clutches 61 and 62. Specifically, the CPU 86*a* of the ECU 86 reads out a map of the type shown in FIG. 14 stored in the memory 86*b*. Here, the map shown in FIG. 14 defines relationship between boat speed integral values and engagement force of the shift position switching hydraulic clutches 61 and 62. The CPU 86*a* applies the calculated boat speed integral value to the map shown in FIG. 14 to calculate engagement force of the shift position switching hydraulic clutches 61 and 62.

Following this, step S5 is performed. In step S5, the ECU 86 changes the engagement force of the shift position switching hydraulic clutches 61 and 62 for the engagement force of the shift position switching hydraulic clutches 61 and 62 to be the engagement force of the shift position switching hydraulic clutches 61 and 62 calculated in step S4.

In this preferred embodiment, when the ECU 86 increases the engagement force of the shift position switching hydraulic clutches 61 and 62 in step S5, the ECU 86 gradually increases the engagement force of the shift position switching hydraulic clutches 61 and 62 to a target engagement force. However, when the engagement force of the shift position switching hydraulic clutches 61 and 62 is increased in step S5, the engagement force of the shift position switching hydraulic clutches 61 and 62 may be increased at once to the target engagement force.

When step S5 ends, the process returns to step S1. Consequently, if the retention switch 94 is on, step S2 to step S5 are repeatedly performed.

The throttle opening degree is generally constantly retained by the ECU 86 over a period when the fixed point retention control is performed. Specifically, the throttle opening degree is retained to be substantially the same opening degree as the throttle opening degree during idling over the period when the fixed point retention control is performed.

The fixed point retention control in this preferred embodiment will be specifically described with reference to a time chart shown in FIG. 15.

Figure 15:
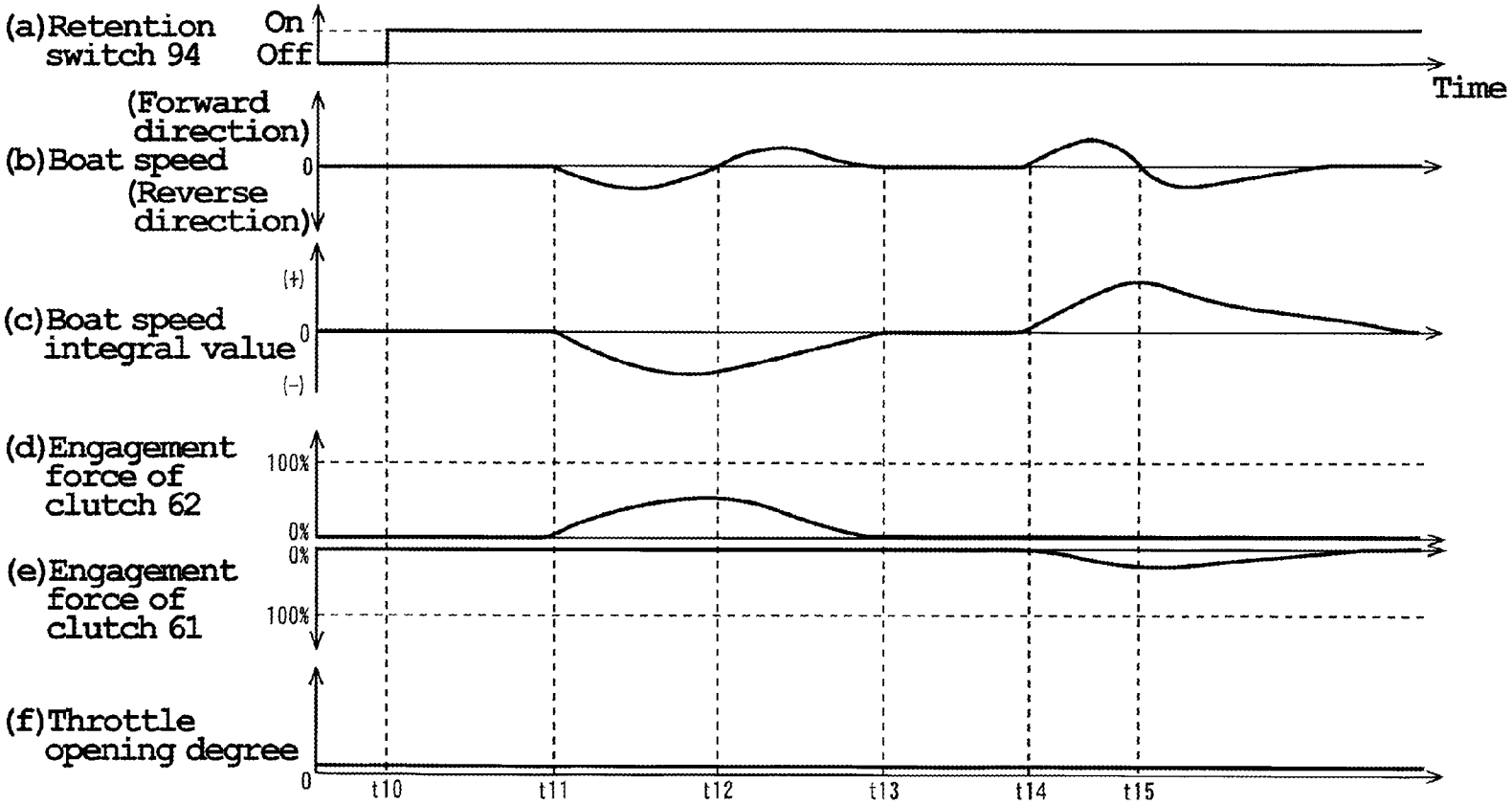
FIG. 15 is a time chart showing an example of the fixed point retention control for the boat in the first preferred embodiment of the present invention.

In an example shown in FIG. 15, the retention switch 94 is turned on at time t10. In the example shown in FIG. 15, boat speed is not generated until time t11. Boat speed in the reverse direction is generated due to an influence of waves or the like from time t11. Consequently, a negative boat speed integral value is calculated from time t11. The negative boat speed integral value becomes large until time t12, when boat speed is 0. Here, the boat speed integral value corresponds to a moving distance of the boat 1. In other words, as the boat speed integral value becomes large on the negative side, the hull 10 has correspondingly moved to the reverse direction.

As shown in FIG. 15(*c*), the boat speed integral value becomes large on the negative side from time t11 to time t12. Consequently, an engagement force of the shift position switching hydraulic clutch 62 is enhanced from time t11 to time t12. Consequently, a propulsive force in the forward direction is generated by the propeller 41. As a result, the boat speed becomes 0 at time t12 as shown in FIG. 15(*b*). Then, boat speed in the forward direction is generated from time t12. Consequently, as shown in FIG. 15(*c*), the boat speed integral value approaches 0 in a period from time t12 to time t13. In other words, the hull 10 is propelled toward a fixed point that is a position of the hull 10 at time t10.

As shown in FIG. 15(*c*), the boat speed integral value approaches 0 in the period from time t12 to time t13. Consequently, an engagement force of the shift position switching hydraulic clutch 62 becomes gradually weaker.

The boat speed integral value becomes 0 at time t13 in the time chart shown in FIG. 15. Then, the boat speed integral value is 0 in a period from time t13 to time t14. Consequently, both of the first shift position switching hydraulic clutch 61 and the second shift position switching hydraulic clutch 62 are disengaged in the period from time t13 to t14.

In the example shown in FIG. 15, boat speed in the forward direction is generated at time t14. Consequently, the hull 10 begins to move in the forward direction at time t14. As a result, a positive boat speed integral value is calculated as shown in FIG. 15(*c*). Therefore, engagement force of the first shift position switching hydraulic clutch 61 is enhanced from time t14. As a result, boat speed in the reverse direction is generated at a time from time t15, and a position of the boat 1 approaches the fixed point.

In the example shown in FIG. 15, the throttle opening degree is generally retained constantly in a state that the retention switch 94 is turned on. Specifically, the throttle opening degree in the state that the retention switch 94 is turned on is retained to be substantially the same opening degree as the throttle opening degree during idling.

(2) Deceleration Control

Deceleration control performed when the deceleration switch 95 is operated by the operator in this preferred embodiment will be described hereinafter in detail with reference to FIG. 16 to FIG. 20.

Figure 16:
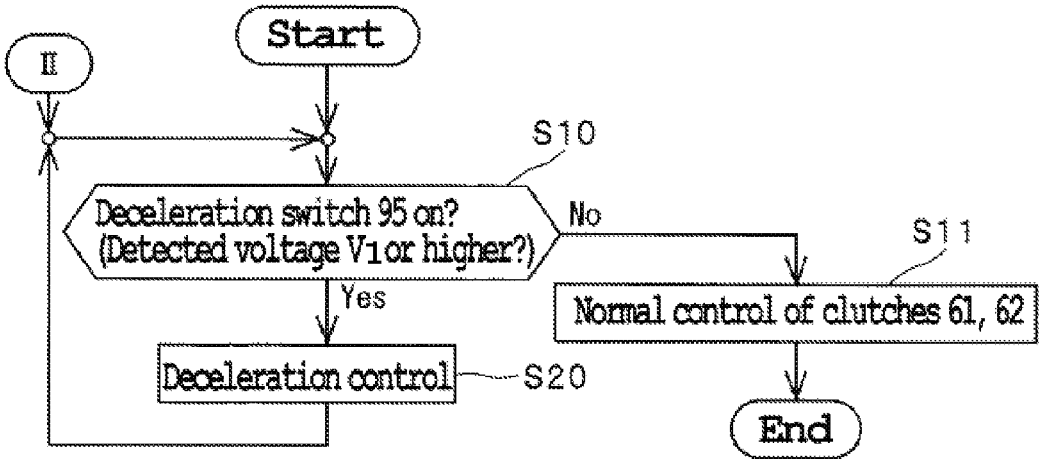
FIG. 16 is a flow chart showing deceleration control in the first preferred embodiment of the present invention.

As shown in FIG. 16, first of all the ECU 86 determines whether or not the deceleration switch 95 is on in step S10. In other words, in step S10, it is determined whether or not voltage detected by the deceleration switch position sensor 96 is a voltage of V1 or higher shown in FIG. 10. If it is determined that the deceleration switch is off in step S10, the process proceeds to step S11.

In step S11, the ECU 86 performs normal control of the shift position switching hydraulic clutches 61 and 62 at a time when the deceleration switch 95 is not operated.

On the other hand, if it is determined that the deceleration switch 95 is on in step S10, the process proceeds to step S20. The deceleration control is performed by the ECU 86 to in step S20. When step S20 ends, the process returns to step S10.

Deceleration control performed in step S20 will be described hereinafter in detail with reference mainly to FIG. 17.

The ECU 86 checks a propulsion direction of the boat 1 in step S21 first of all in the deceleration control in this preferred embodiment.

Following this, step S22 is performed. In step S22, the ECU 86 determines whether or not boat speed is equal to or higher than a threshold based on an output of the boat speed sensor 97. Here, the threshold in step S22 can be appropriately set according to a characteristic or the like of the boat 1. For example, the threshold in step S22 can be set to about 0.5 km/h to about 1.5 km/h.

If it is determined in step S22 that the boat speed is not equal to or higher than the threshold, the process proceeds to step S30. In step S30, the ECU 86 performs boat speed retention control described below.

On the other hand, if it is determined in step S22 that the boat speed is equal to or higher than the threshold, the process proceeds to step S23. In step S23, the ECU 86 determines whether or not a shift position of the shift position switching mechanism 36 and a propulsion direction of the boat 1 are on the same side or the shift position of the shift position switching mechanism 36 is neutral. If it is determined in step S23 that the shift position of the shift position switching mechanism 36 and the propulsion direction of the boat 1 are on the opposite sides, step S24 is not performed, but the process proceeds to step S25. In other words, step S23 is followed by step S25 in the case that the shift position of the shift position switching mechanism 36 is forward and the propulsion direction of the boat 1 is in the reverse direction, and in the case that the shift position of the shift position switching mechanism 36 is reverse and the propulsion direction of the boat 1 is in the forward direction.

On the other hand, in step S23, if the shift position of the shift position switching mechanism 36 and the propulsion direction of the boat 1 are on the same side or if the shift position of the shift position switching mechanism 36 is neutral, then the process proceeds to step S24. In other words, step S23 is followed by step S24 in the case that the shift position of the shift position switching mechanism 36 is forward and the propulsion direction of the boat 1 is in the forward direction, in the case that the shift position of the shift position switching mechanism 36 is reverse and the propulsion direction of the boat 1 is in the reverse direction, and in the case that the shift position of the shift position switching mechanism 36 is neutral.

In step S24, the ECU 86 performs a shift change. Specifically, in step S24, the ECU 86 switches the shift position of the shift position switching mechanism 36 for the shift position of the shift position switching mechanism 36 to be on a side opposite to the propulsion direction of the boat 1. In other words, in step S24, the shift position of the shift position switching mechanism 36 is made to be reverse when the propulsion direction of the boat 1 is in the forward direction. On the other hand, when the propulsion direction of the boat 1 is in the forward direction, the shift position of the shift position switching mechanism 36 is reversed. After step S24, step S25 is performed.

In step S25, the ECU 86 calculates a target throttle opening degree. Specifically, the CPU 86*a* of the ECU 86 reads out a map shown in FIG. 11 stored in the memory 86*b*. The CPU 86*a* applies voltage of a deceleration signal output from the deceleration switch position sensor 96 to the map shown in FIG. 11 to calculate the target throttle opening degree.

Following this, step S26 is performed. In step S26, the ECU 86 sets an upper limit of the throttle opening degree. Specifically, in step S26, the CPU 86*a* of the ECU 86 reads out a relationship shown in FIG. 18 and stored in the memory 86*b*. Here, the relationship shown in FIG. 18 defines propulsion speed and upper limits of the throttle opening degree. The CPU 86*a* applies a propulsion speed of the boat 1 output from the boat speed sensor 97 to the relationship shown in FIG. 18 to calculate the throttle opening degree upper limit.

Following step S26, step S27 is performed. In step S27, the ECU 86 performs an adjustment of the throttle opening degree based on the throttle opening degree calculated in step S25 and the throttle opening degree upper limit calculated in step S26. Specifically, when the target throttle opening degree calculated in step S25 is below the throttle opening degree upper limit calculated in step S26, the CPU 86*a* adjust the throttle opening degree to the target throttle opening degree calculated in step S25. On the other hand, when the target throttle opening degree calculated in step S25 is above the throttle opening degree upper limit calculated in step S26, the CPU 86*a* adjusts the throttle opening degree to the throttle opening degree upper limit calculated in step S26.

Figure 17:
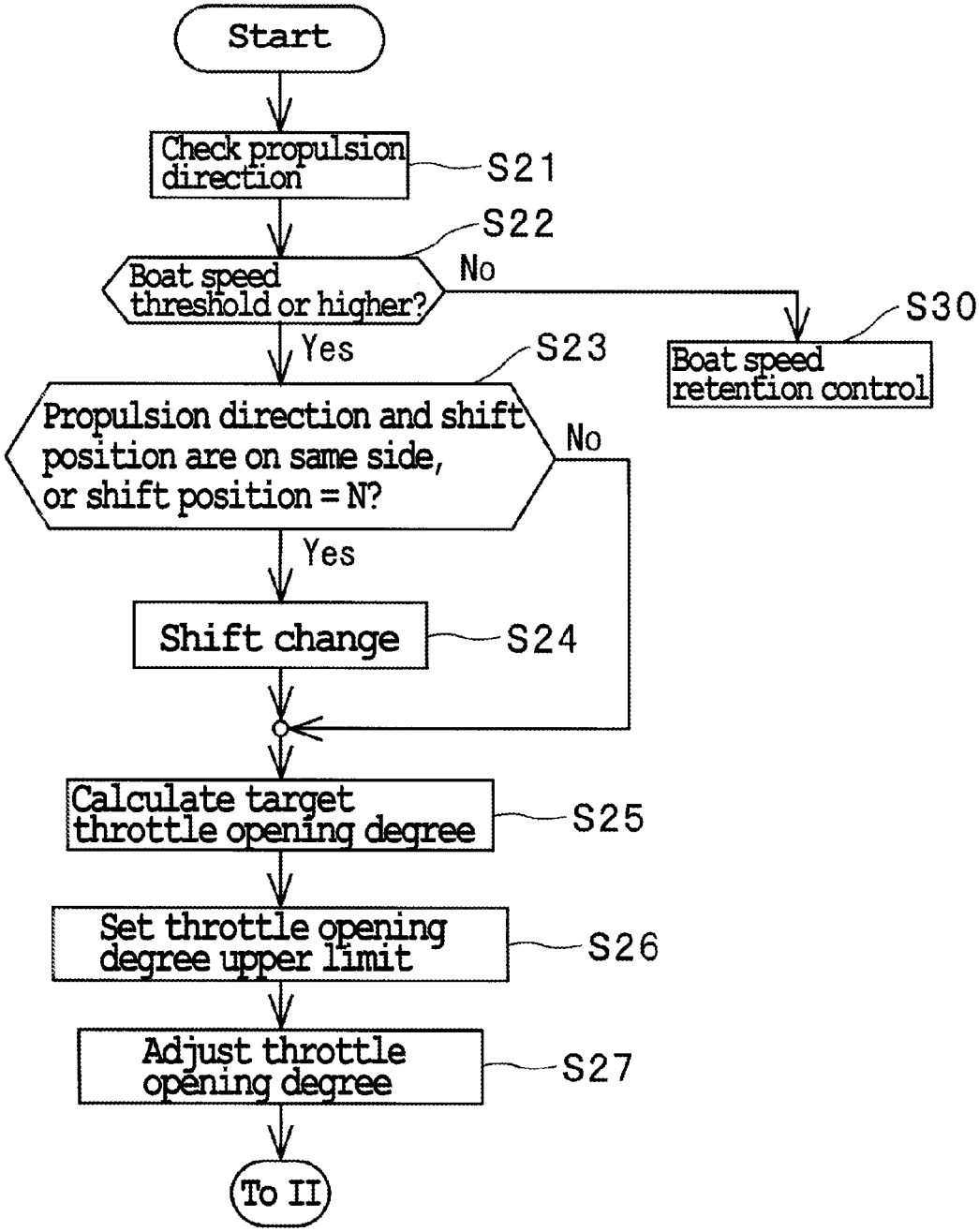
FIG. 17 is another flow chart showing the deceleration control in the first preferred embodiment of the present invention.
Figure 18:
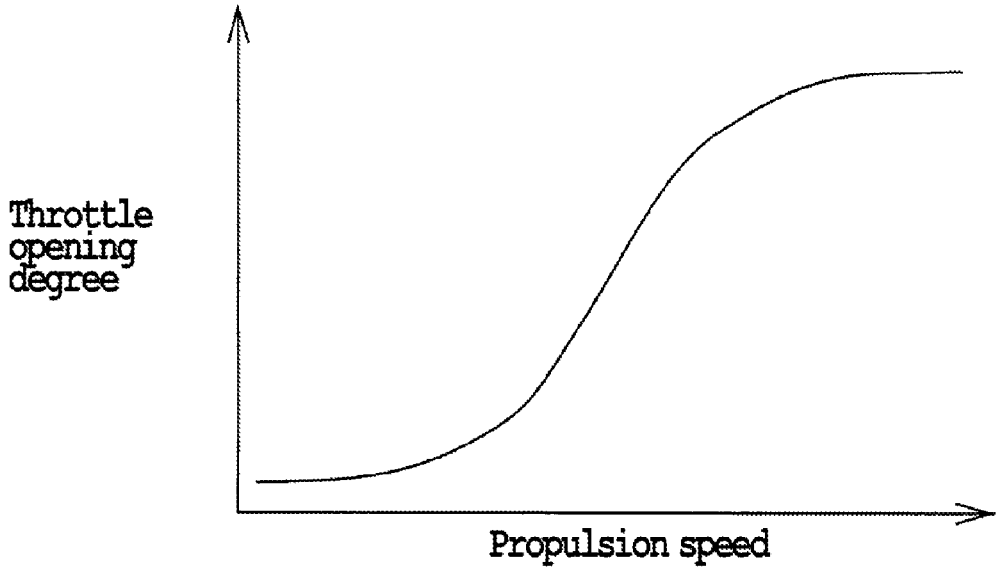
FIG. 18 is a map for defining a relationship between propulsion speed and throttle opening degrees.

When step S27 ends, the process returns to step S10 as shown in FIG. 17 and FIG. 16. In other words, continuous control is repeatedly performed over a period of time when the deceleration switch 95 is on.

Specific details of boat speed retention control performed in step S30 shown in FIG. 17 will be described hereinafter in detail with reference to FIG. 19 and FIG. 20.

Figure 19:
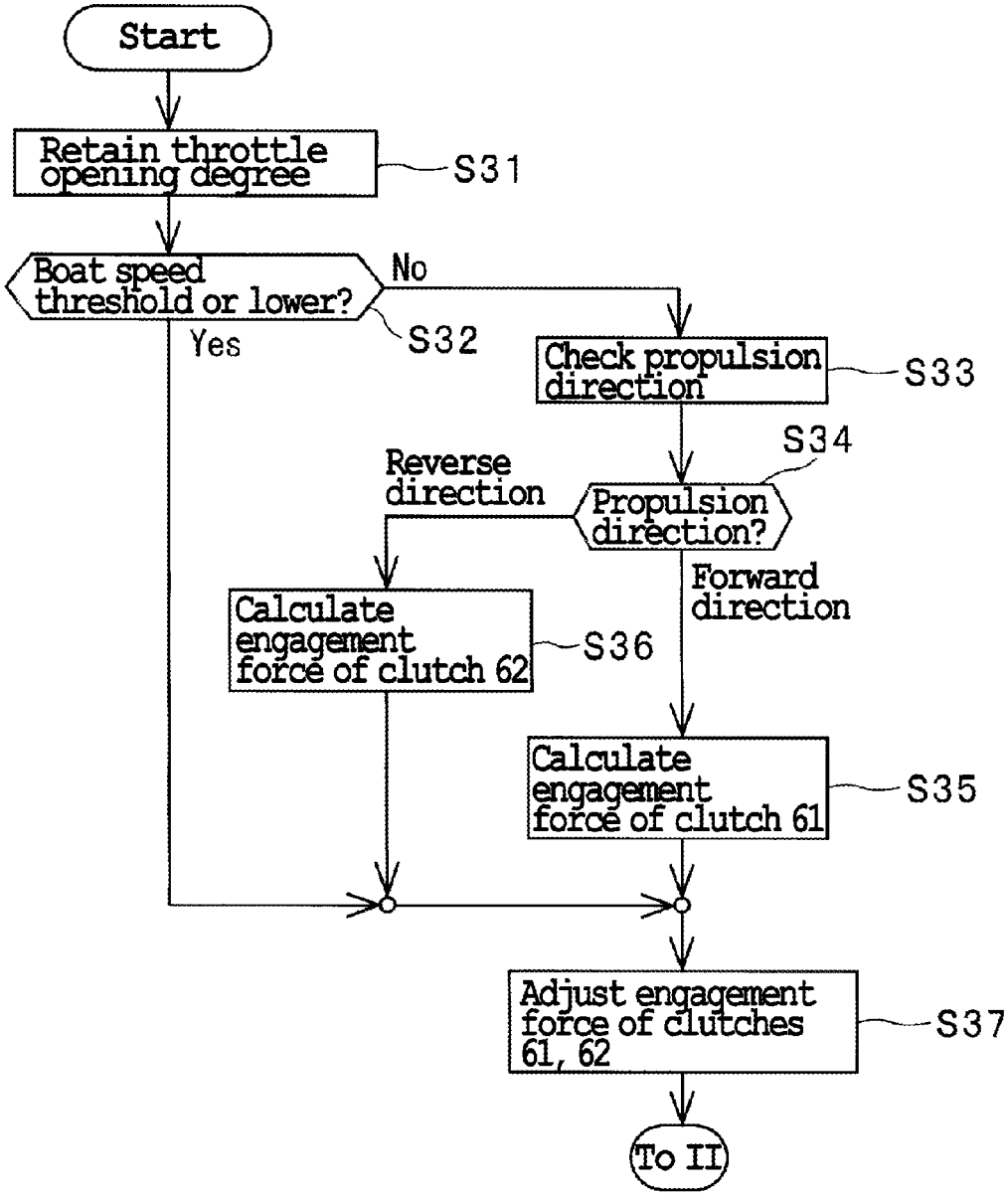
FIG. 19 is a flowchart showing boat speed retention control in the first preferred embodiment of the present invention.

As shown in FIG. 19, in the boat speed retention control, first of all a current throttle opening degree is retained by the ECU 86 in step S31.

Following this, step S32 is performed. In step S32, the ECU 86 determines whether or not boat speed is less than or equal to a threshold based on the boat speed signal output from the boat speed sensor 97. If it is determined in step S32 that the boat speed is less than or equal to the threshold, steps S33 to S36 are not performed, but the process proceeds to step S37.

On the other hand, if it is determined in step S32 that the boat speed is above the threshold, the process proceeds to step S33.

The threshold in step S32 can be appropriately set according to a characteristic or the like of the boat 1. For example, the threshold in step S32 can be set to about 0.5 km/h to about 1.5 km/h.

In step S33, the ECU 86 checks a propulsion direction of the boat 1 based on the boat speed output from the boat speed sensor 97.

Following this, step S34 is performed. In step S34, the ECU 86 determines a propulsion direction of the boat 1. If it is determined in step S34 that the propulsion direction of the boat 1 is in the forward direction, the process proceeds to step S35. In step S35, the CPU 86*a* calculates engagement force of the first shift position switching hydraulic clutch 61. On the other hand, if it is determined in step S34 that the propulsion direction of the boat 1 is in the reverse direction, the process proceeds to step S36. In step S36, the ECU 86 calculates an engagement force of the second shift position switching hydraulic clutch 62.

Specifically, in this preferred embodiment, the engagement force of the shift position switching hydraulic clutches 61 and 62 in step S35 and in step S36 is calculated as described below. The CPU 86*a* calculates (−propeller rotational speed) which is obtained by multiplying a current propeller rotational speed output from the propeller rotational speed sensor 90 by (−1). Then, the CPU 86*a* multiplies (−propeller rotational speed) by a gain. A type of the gain is not specifically limited.

Figure 20:
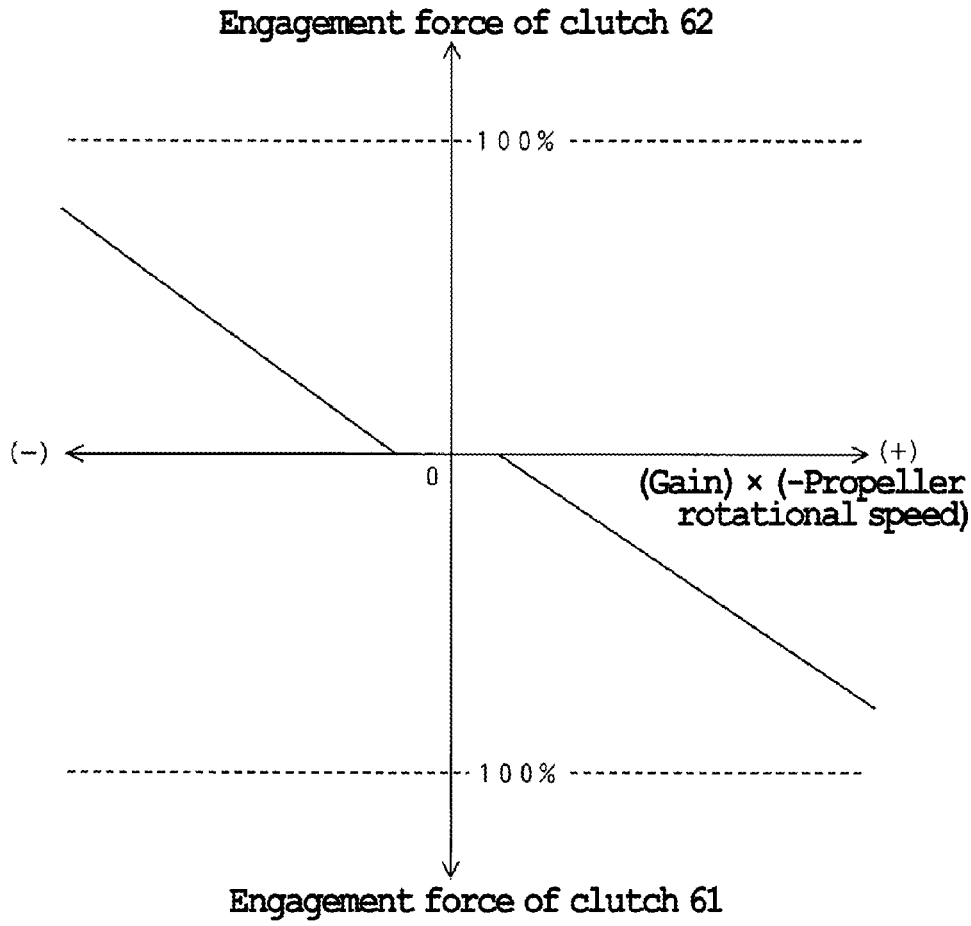
FIG. 20 is a map for defining (gain)×(−propeller rotational speed) and engagement force of the shift position switching hydraulic clutch.

The CPU 86*a* applies the calculated (gain)×(−propeller rotational speed) to a relationship shown in FIG. 20 stored in the memory 86*b* to calculate the engagement force of the shift position switching hydraulic clutches 61 and 62.

Following step S35 and step 36, step S37 is performed. In step S37, the ECU 86 adjusts the engagement force of the shift position switching hydraulic clutches 61 and 62.

For example, a fixed point retention control system in which an actuator is driven based on a deviation between a position signal from the GPS and a position command value is disclosed in JP-B-3499204. According to JP-B-3499204, the actuator drives a thruster, a rudder, and a propulsion unit. In other words, an output of an engine is adjusted based on the deviation between the position signal and the position command value in the fixed point retention control system disclosed in JP-B-3499204.

However, when only an output of the engine is controlled as in the fixed point retention control system for a boat disclosed in JP-B-3499204, it is difficult to provide the boat with a very small propulsive force. Therefore, it is difficult to accurately retain the boat at a fixed point.

On the other hand, in this preferred embodiment, when the retention switch 94 is turned on by the operator, the ECU 86 as a control device adjusts engagement force of the first and second shift position switching hydraulic clutches 61 and 62. Consequently, propulsive force generated by the outboard motor 20 can be more finely adjusted than, for example, the case that the output of the engine 30 is adjusted. Therefore, according to the preferred embodiment, it is possible to accurately retain the boat 1 at a fixed point.

Only the engagement force of the shift position switching hydraulic clutches 61 and 62 is adjusted in the fixed point retention control in this preferred embodiment. However, the present invention is not limited to this configuration. For example, in the fixed point retention control of the present invention, an output of the engine 30 may be adjusted in addition to the engagement force of the shift position switching hydraulic clutches 61 and 62.

In this preferred embodiment, the position of the hull 10 at a time when the retention switch 94 is turned on is defined to be a fixed point. Consequently, the operator can easily retain the boat 1 on a desired fixed point by operating the retention switch 94 on a position where he or she desires to stop the boat.

In this preferred embodiment, an engagement force of the shift position switching hydraulic clutches 61 and 62 is gradually increased in step S5 shown in FIG. 12 until it reaches the target engagement force. Consequently, it is possible to suppress a sudden change in propulsive force generated for the boat 1.

In this preferred embodiment, a type of the shift position switching hydraulic clutches 61 and 62 is not specifically limited. However, it is preferable that the shift position switching hydraulic clutches 61 and 62 are a multi-plate clutch because this makes it easy to finely adjust engagement force of the shift position switching hydraulic clutches 61 and 62.

Figure 14:
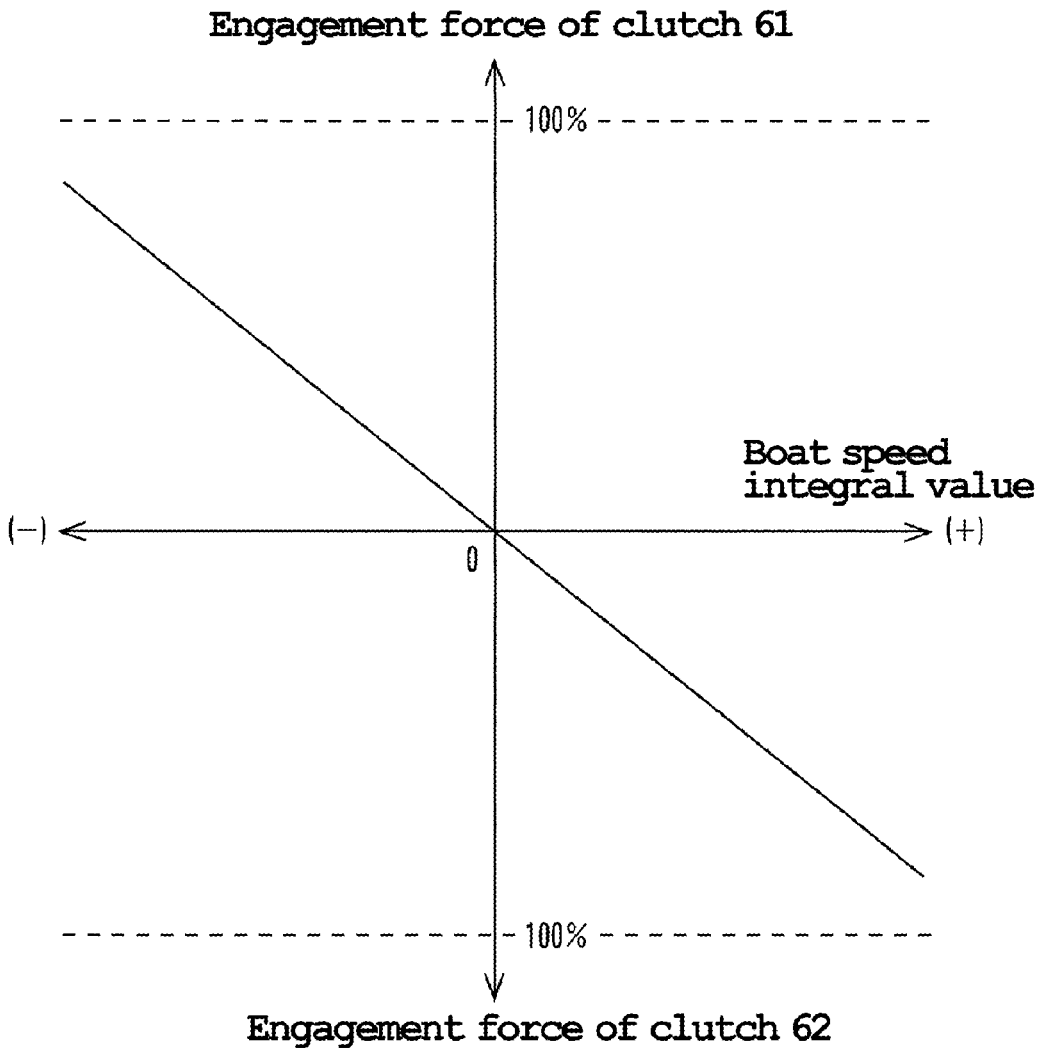
FIG. 14 is a map for defining a relationship between boat speed integral values and engagement force of a shift position switching hydraulic clutch.

In this preferred embodiment, engagement force of the shift position switching hydraulic clutches 61 and 62 is adjusted according to a boat speed integral value that correlates with a moving distance of the boat 1 as shown in FIG. 14. Specifically, as the moving distance of the boat 1 increases, and as the boat speed integral value increases, engagement force of the shift position switching hydraulic clutches 61 and 62 is made to be large. Consequently, when the boat 1 is extremely far away from a fixed point, a larger propulsive force is applied to the boat 1. Therefore, it is possible to return the boat 1 at once to the fixed point.

Further, when the moving distance of the boat 1 is small, engagement force of the shift position switching hydraulic clutches 61 and 62 is made small. Consequently, it is possible to make small the propulsive force generated the boat 1. Therefore, it is possible to further accurately retain the boat 1 on a fixed point.

Second Preferred Embodiment

In the first preferred embodiment described above, the boat 1 having only one outboard motor 20 as a boat propulsion system is described to describe one example of a preferred embodiment of the present invention. However, the boat according to the present invention may have a plurality of boat propulsion systems. In this preferred embodiment, the boat 2 that has two outboard motors 20*a* and 20*b* shown in FIG. 21 will be described.

In the description below, members that have substantially the same functions as those in the first preferred embodiment above will be referenced with the same reference numerals and symbols, and the description thereof will be omitted. FIG. 2 to FIG. 5, FIG. 7 to FIG. 11, and FIG. 16 to FIG. 20 will be referenced commonly with the first preferred embodiment above.

Figure 21:
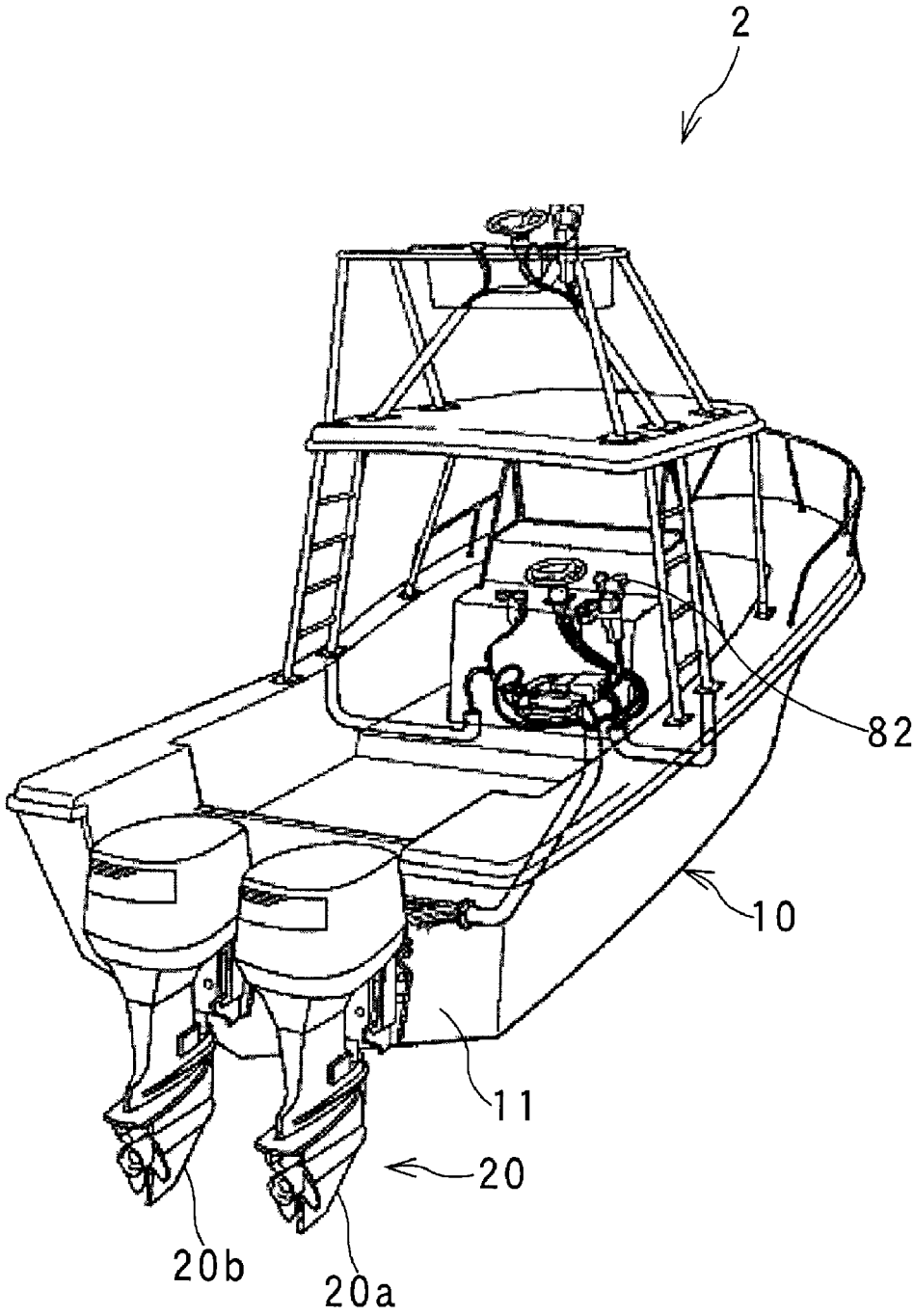
FIG. 21 is a view of a boat according to a second preferred embodiment of the present invention when viewed from an obliquely rearward direction.
Figure 22:
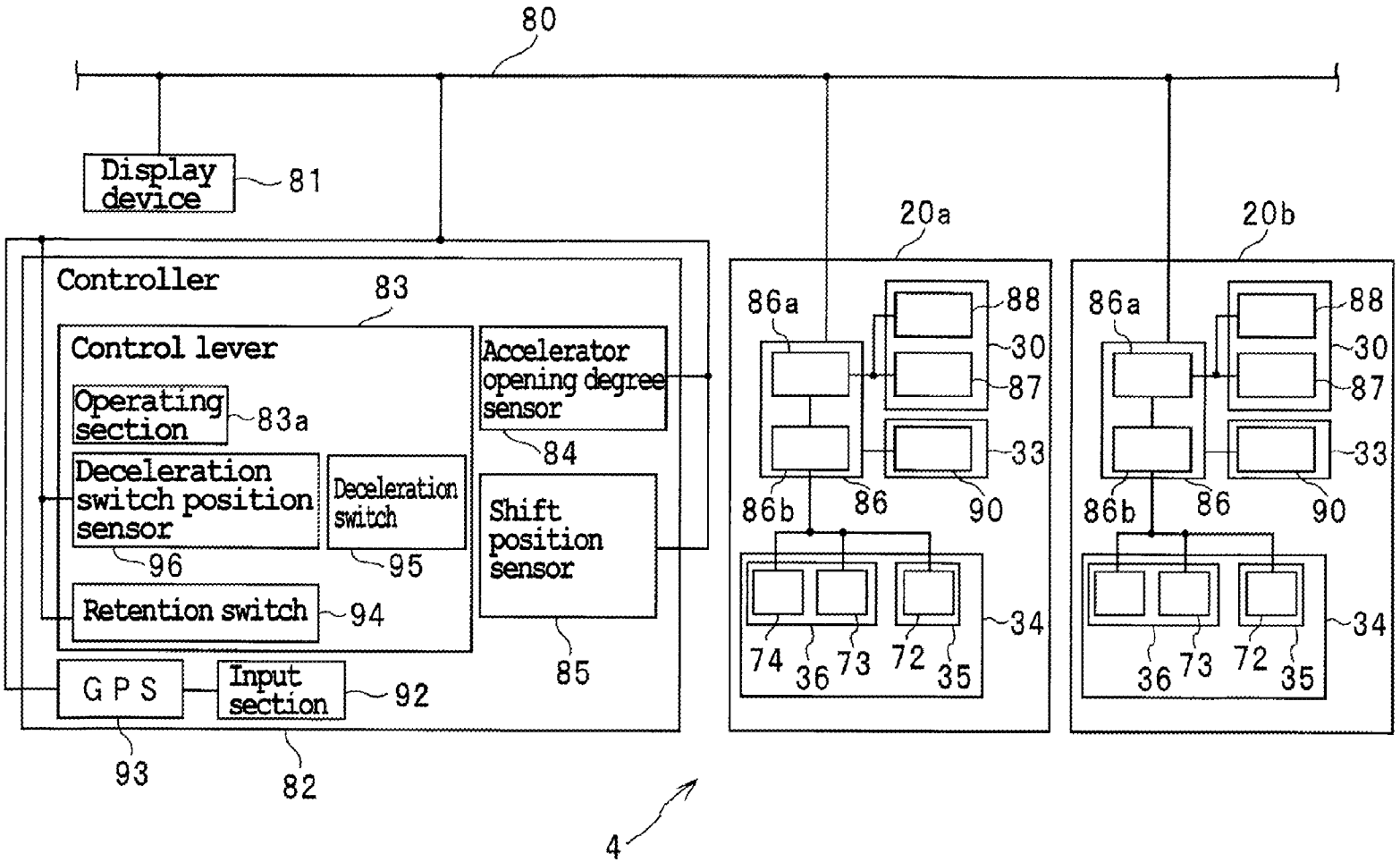
FIG. 22 is a control block diagram of the boat in the second preferred embodiment of the present invention.

As shown in FIG. 21, the boat 2 according to the second preferred embodiment is provided with the two outboard motors 20*a* and 20*b*. The outboard motors 20*a* and 20*b* are mounted on the stern 11 side by side with each other. As shown in FIG. 22, the outboard motors 20*a* and 20*b* are connected to the controller 82 via the LAN 80. The outboard motors 20*a* and 20*b* are controlled by the controller 82.

Specific details of fixed point retention control in this preferred embodiment will be described hereinafter with reference to FIG. 23 to FIG. 32.

Figure 23:
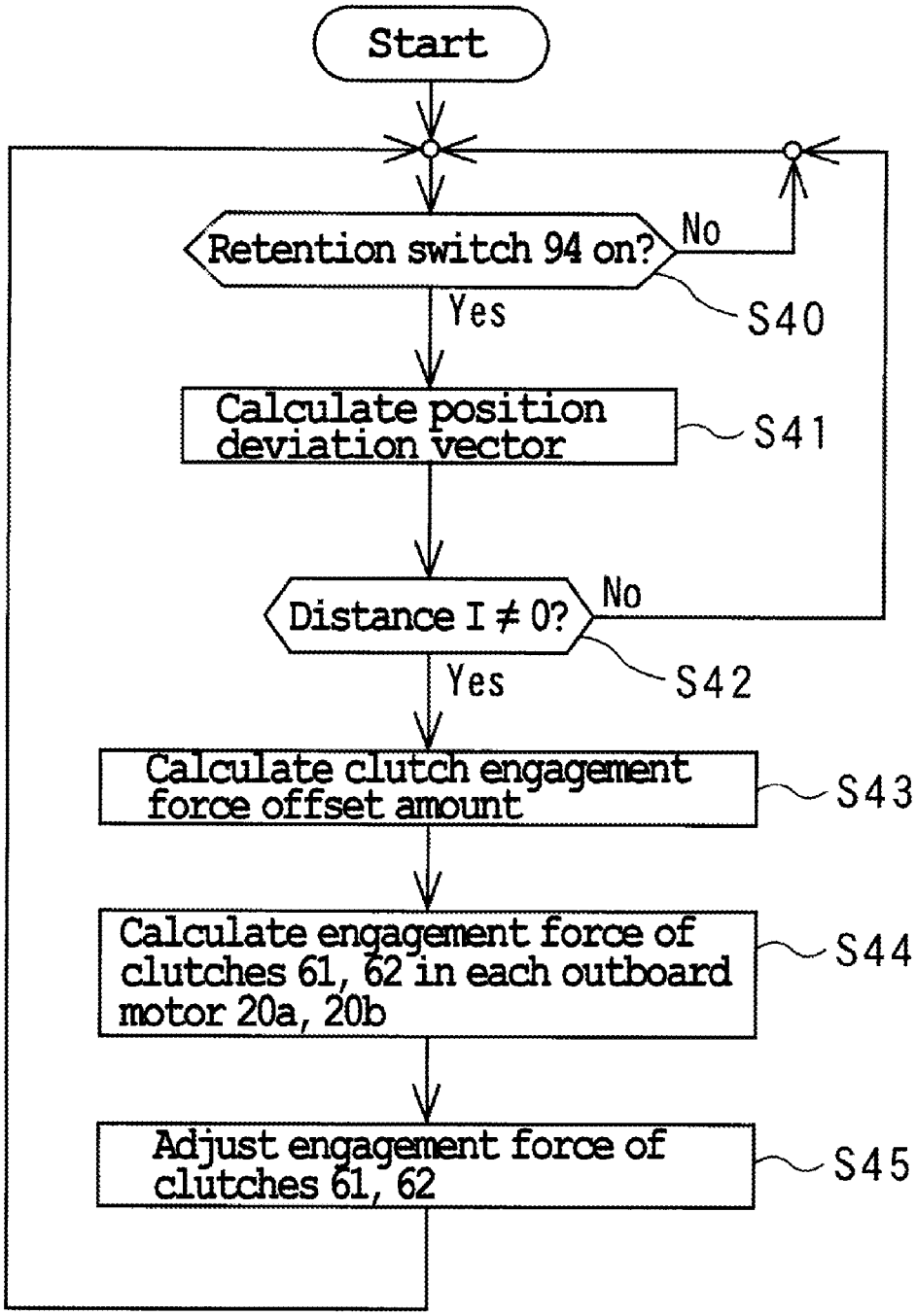
FIG. 23 is a flow chart showing fixed point retention control for the boat in the second preferred embodiment of the present invention.

In this preferred embodiment, step S40 is performed first of all as shown in FIG. 23. In step S40, the ECU 86 determines whether or not the retention switch 94 is turned on based on a signal output from the retention switch 94. If it is determined in step 40 that the retention switch 94 is off, the process returns to step S40.

Figure 24:
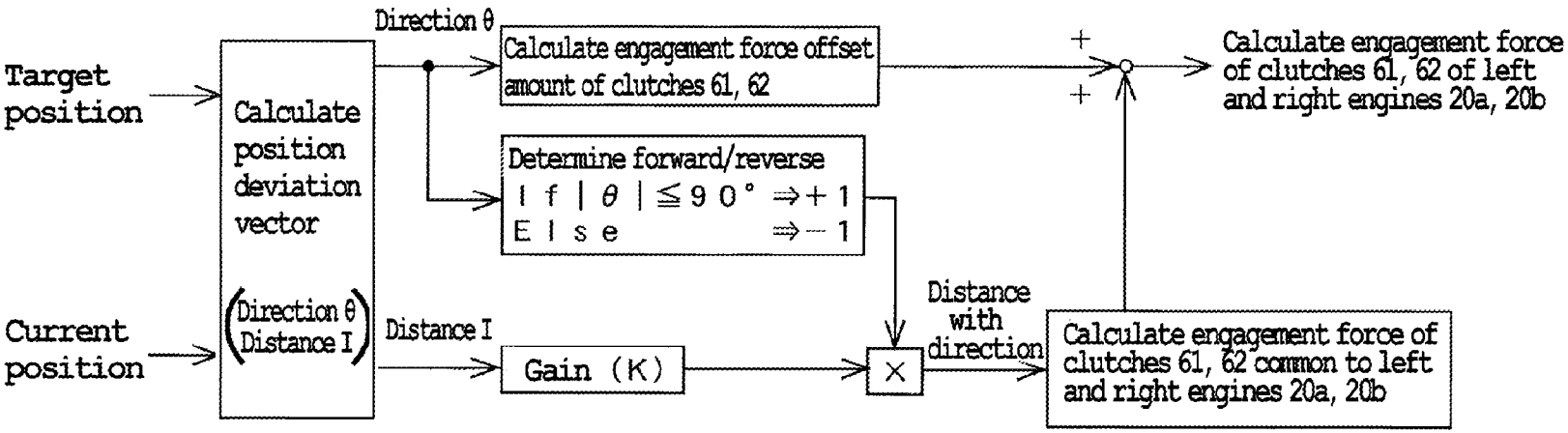
FIG. 24 is a block line diagram showing the fixed point retention control for the boat in the second preferred embodiment of the present invention.
Figure 25:
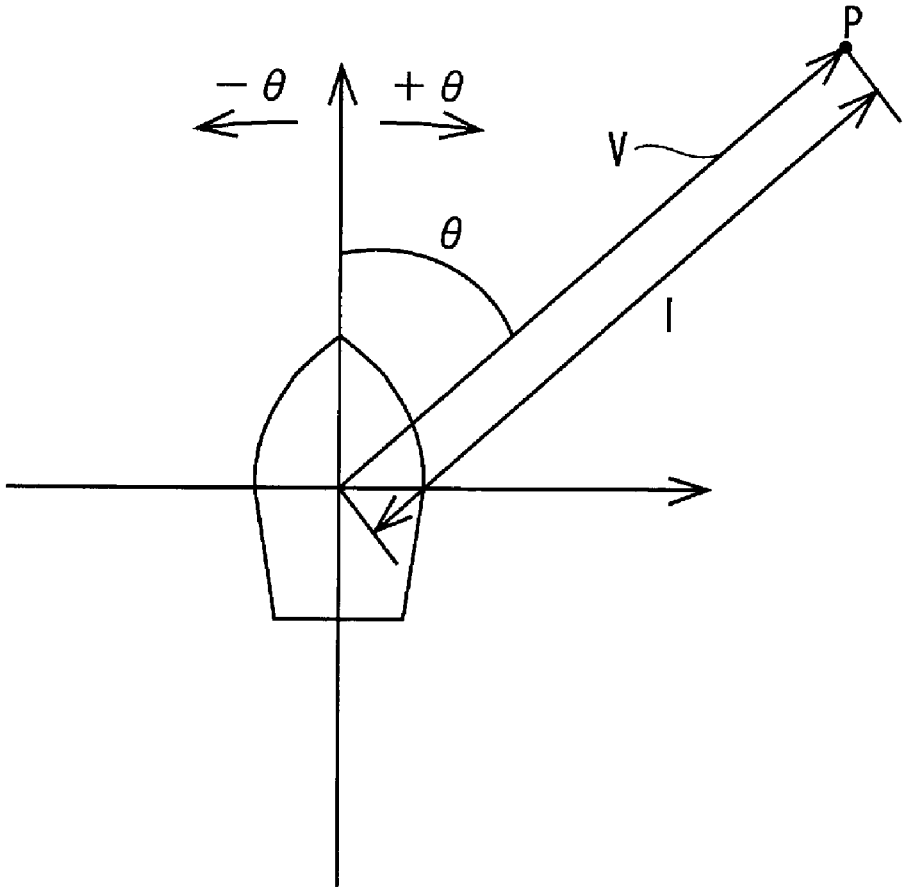
FIG. 25 is a schematic diagram for illustrating a position deviation vector.
Figure 26:
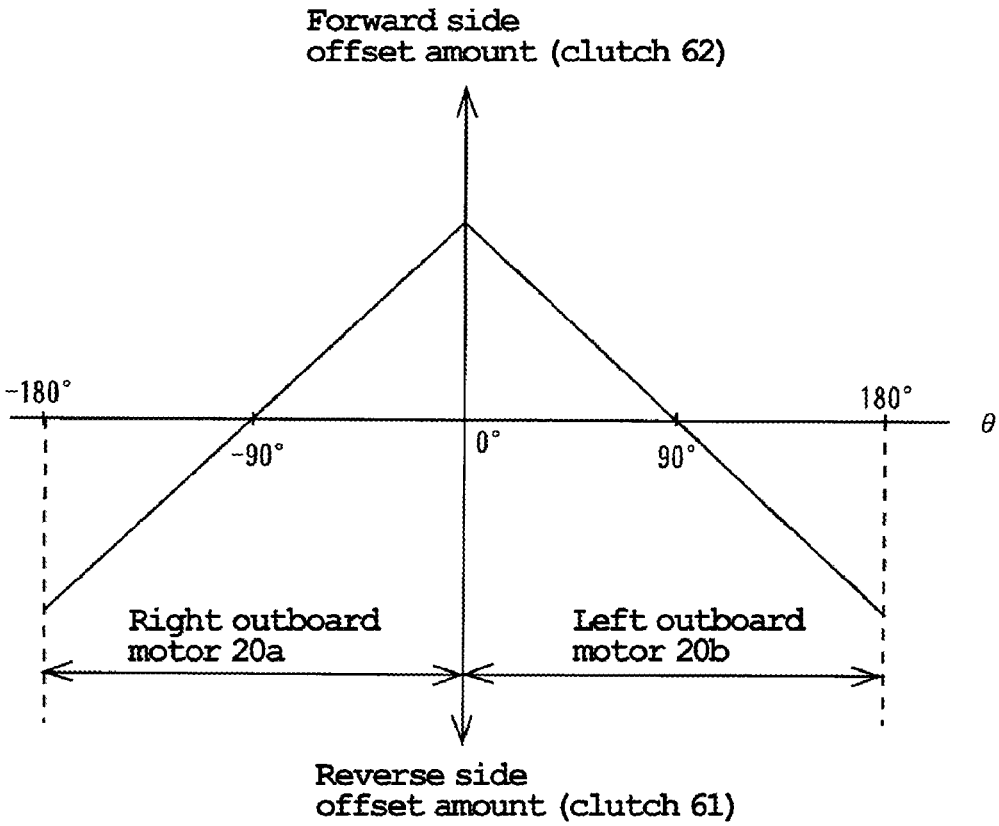
FIG. 26 is a map for defining relationship between angle θ and a clutch engagement force offset amount.

On the other hand, if it is determined in step S40 that the retention switch 94 is on, the process proceeds to step S41. In step S41, the ECU 86 calculates a position deviation vector. Specifically, as shown in FIG. 24, the ECU 86 calculates the position deviation vector based on a fixed point as a target position and a current position detected by the GPS 93. FIG. 25 shows position deviation vector V. In FIG. 25, P indicates a fixed point. As shown in FIG. 25, position deviation vector V includes distance I between the current position and fixed point P and angle θ as information. When fixed point P is on the right side with respect to the current position of the boat 2, angle θ is a positive value. On the other hand, when fixed point P is on the left side with respect to the current position of the boat 2, angle θ is a negative value.

As shown in FIG. 23, step S42 is performed following step S41. In step S42, the ECU 86 determines whether or not distance I shown in FIG. 25 is 0. If it is determined that distance I is 0 in step S42, the process returns to step S40.

On the other hand, if it is determined that distance I is not 0 in step S42, the process proceeds to step S43.

In step S43, the CPU 86*a* of the ECU 86 calculates a clutch engagement force offset amount. Here, the clutch engagement force offset amount is an offset amount between engagement force of the shift position switching hydraulic clutches 61 and 62 of the right outboard motor 20*a* and engagement force of the shift position switching hydraulic clutches 61 and 62 of the left outboard motor 20*b*. Specifically, the CPU 86*a* reads out a map shown in FIG. 26 stored in the memory 86*b* in step S43. The map shown in FIG. 26 defines a relationship between angle θ and a clutch engagement force offset amount. The CPU 86*a* applies angle θ to the map shown in FIG. 26 to calculate the clutch engagement force offset amount.

Following this, step S44 is performed. In step S44, the CPU 86*a* of the ECU 86 calculates engagement force of the shift position switching hydraulic clutches 61 and 62 in each of the outboard motors 20*a*, 20*b*. The engagement force of the shift position switching hydraulic clutches 61 and 62 calculated in step S44 is a value common to the right outboard motor 20*a* and the left outboard motor 20*b*. Specifically, as shown in FIG. 24, the CPU 86*a* multiplies distance I by a gain (K). In addition, if the absolute value of θ is about 90° or less, the CPU 86*a* multiplies (L×K) by (+1). On the other hand, if the absolute value of θ is larger than about 90°, the CPU 86*a* multiplies (L×K) by (−1). An engagement force of the shift position switching hydraulic clutches 61 and 62 in each of the outboard motors 20*a* and 20*b* is calculated based on the value (L×K) or (−L×K) obtained as described above. Then, the engagement force of the shift position switching hydraulic clutches 61 and 62 calculated in step S44 and the clutch engagement force offset amount calculated in step S43 are added to calculate engagement force of the shift position switching hydraulic clutches 61 and 62 of the right outboard motor 20*a* and engagement force of the shift position switching hydraulic clutches 61 and 62 of the left outboard motor 20*b*.

Following this, step S45 is performed. In step S45, the CPU 86*a* adjusts the engagement force of the shift position switching hydraulic clutches 61 and 62 to become the calculated engagement force of the shift position switching hydraulic clutches 61 and 62 of each of the outboard motors 20*a* and 20*b*.

If the calculated engagement force of the shift position switching hydraulic clutches 61 and 62 exceeds about 100%, engagement force of the shift position switching hydraulic clutches 61 and 62 is set to about 100%. Further, if the calculated engagement force of the shift position switching hydraulic clutches 61 and 62 is a negative value, engagement force of the shift position switching hydraulic clutches 61 and 62 on an opposite side is increased. For example, if engagement force of the shift position switching hydraulic clutch 61 is calculated to be about −20%, the engagement force of the shift position switching hydraulic clutch 62 is adjusted to about 20%.

When step S45 ends, the process returns to step S40. Therefore, step S41 to step S45 are repeatedly performed over a period of time when the retention switch 94 is on.

Figure 27:
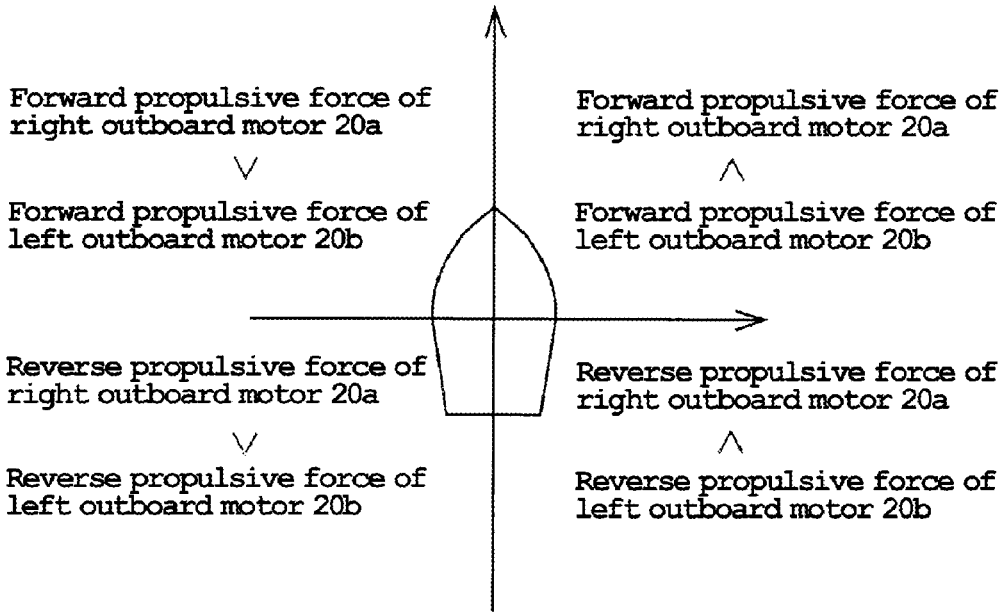
FIG. 27 is a map showing a relationship between a direction of a fixed point with respect to a position of a boat and propulsive force of a right outboard motor and a left outboard motor.
Figure 28:
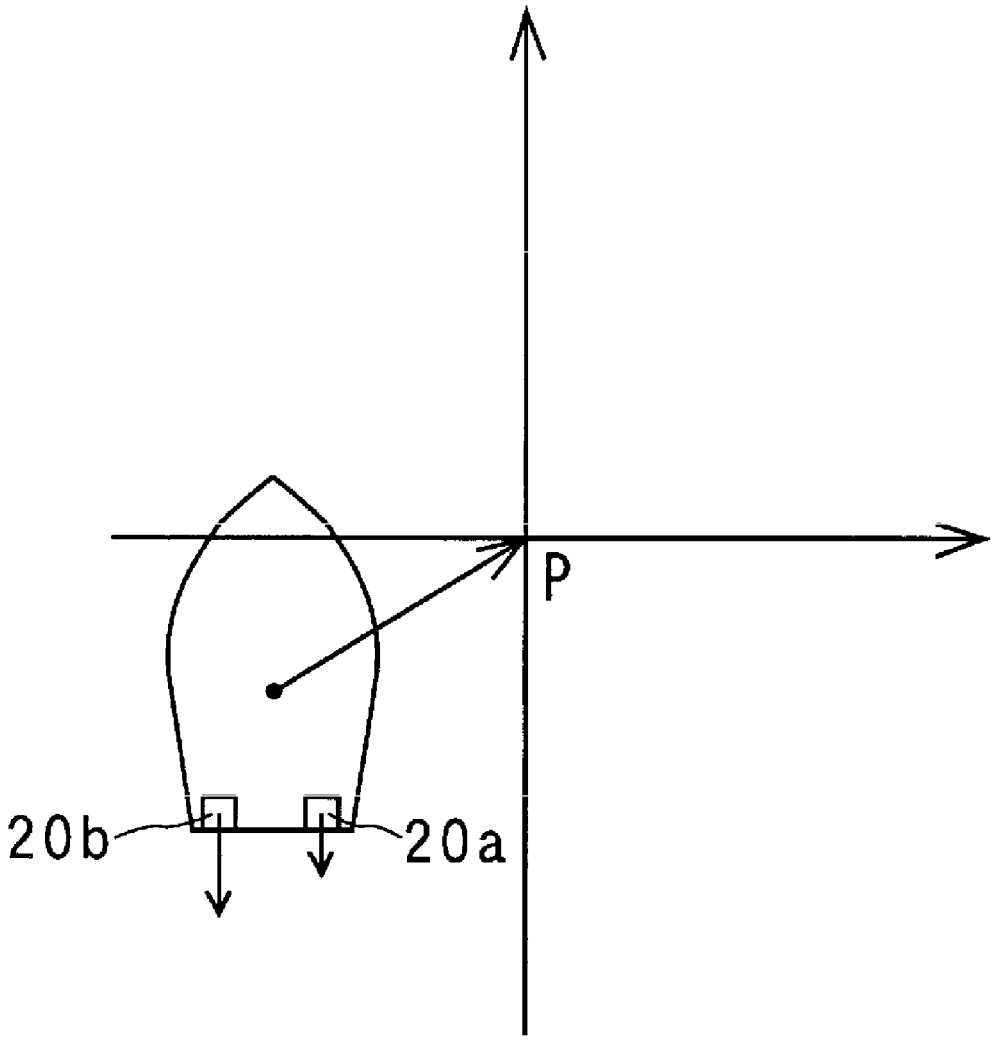
FIG. 28 is a schematic diagram showing propulsive force of the right outboard motor and the left outboard motor when the boat is located in a left rear direction with respect to the fixed point.

The propulsive force generated in the right outboard motor 20*a* and the left outboard motor 20*b* by the fixed point retention control shown in FIG. 23 is as shown in FIG. 27 to FIG. 31. Specifically, as shown in FIG. 27 and FIG. 28, when fixed point P is right forward with respect to a current position of the boat 2, forward propulsive force of the left outboard motor 20*b* is adjusted to be larger than forward propulsive force of the right outboard motor 20*a*.

Figure 29:
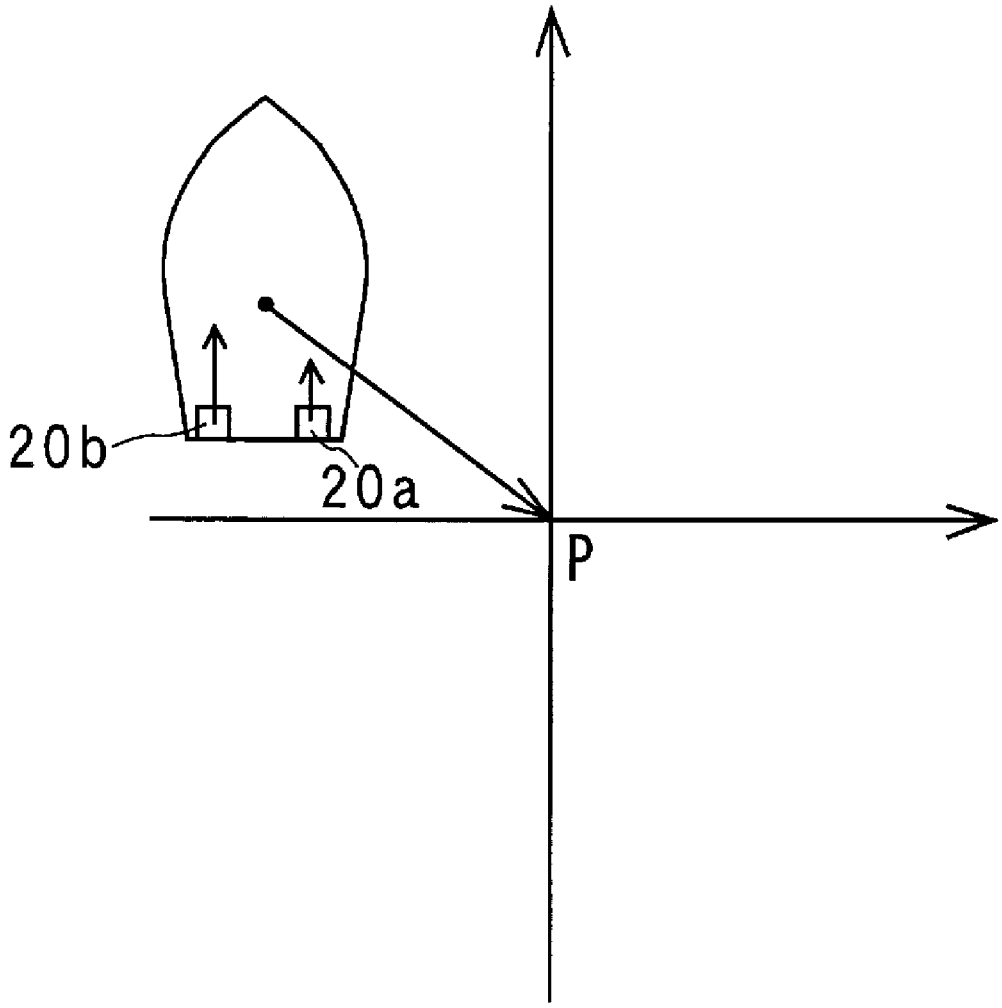
FIG. 29 is a schematic diagram showing propulsive force of the right outboard motor and the left outboard motor when the boat is located in a left front direction with respect to the fixed point.

As shown in FIG. 27 and FIG. 29, when fixed point P is right and rearward with respect to a current position of the boat 2, reverse propulsive force of the left outboard motor 20*b* is adjusted to be larger than reverse propulsive force of the right outboard motor 20*a*.

Figure 30:
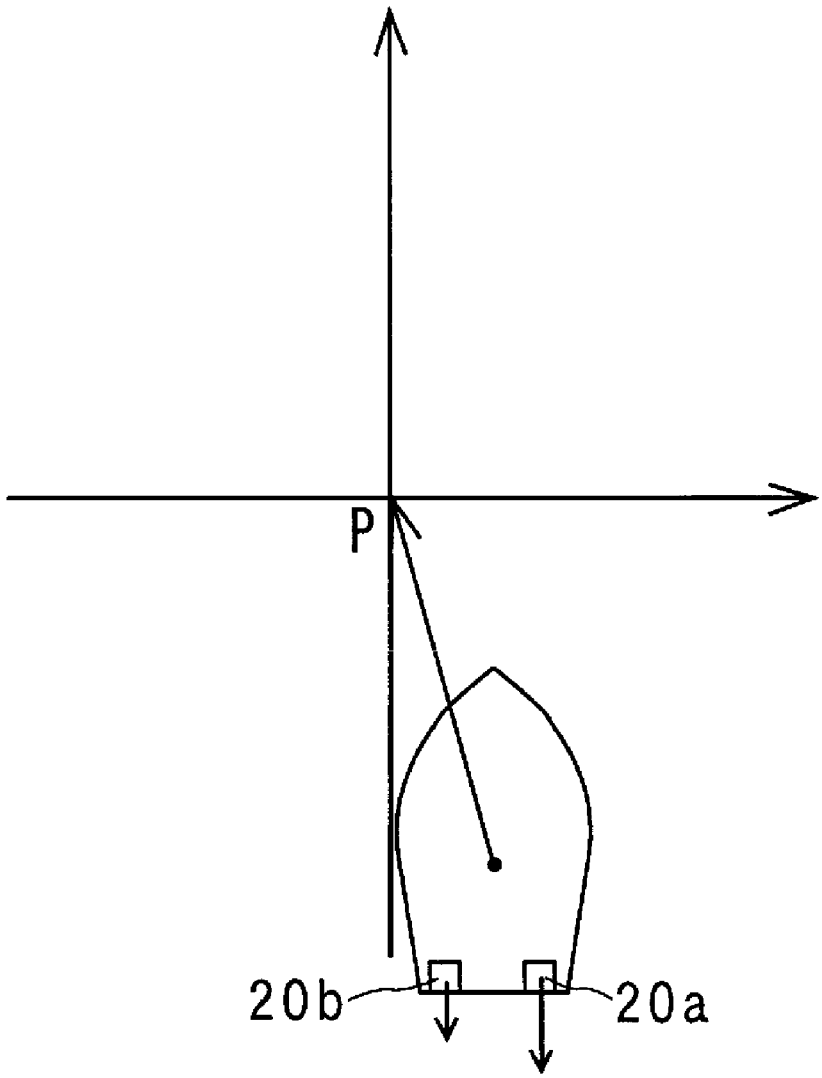
FIG. 30 is a schematic diagram showing propulsive force of the right outboard motor and the left outboard motor when the boat is located in a right rear direction with respect to the fixed point.

As shown in FIG. 27 and FIG. 30, when fixed point P is left and forward with respect to a current position of the boat 2, forward propulsive force of the right outboard motor 20*a* is adjusted to be larger than forward propulsive force of the left outboard motor 20*b*.

Figure 31:
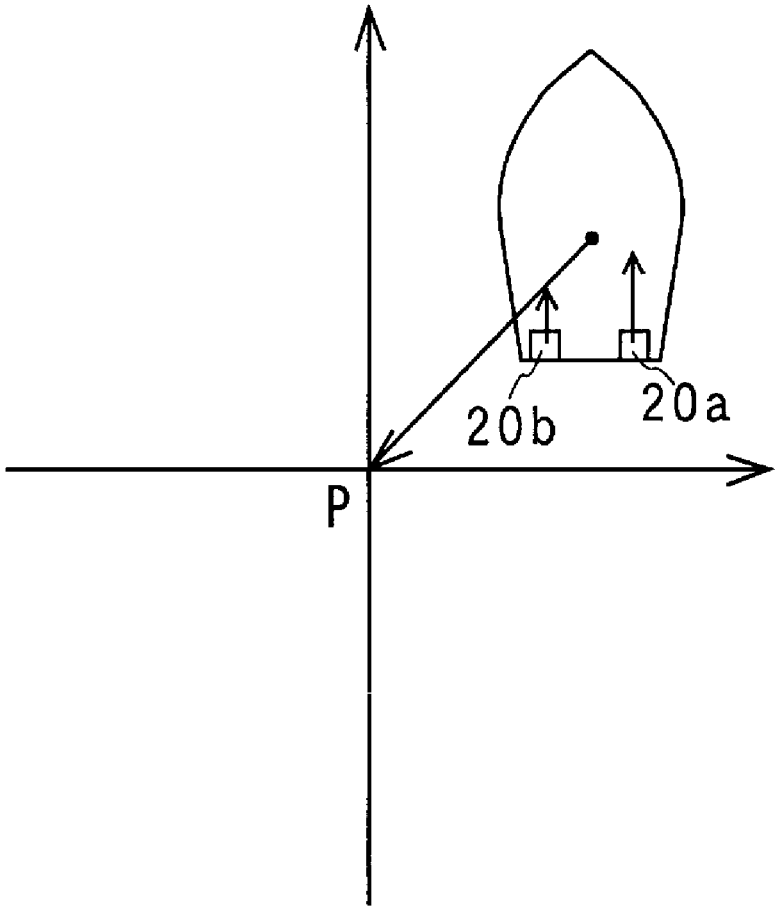
FIG. 31 is a schematic diagram showing propulsive force of the right outboard motor and the left outboard motor when the boat is located in a right front direction with respect to the fixed point.

As shown in FIG. 27 and FIG. 31, when fixed point P is left rearward with respect to a current position of the boat 2, reverse propulsive force of the right outboard motor 20*a* is adjusted to be larger than reverse propulsive force of the left outboard motor 20*b*.

Figure 32:
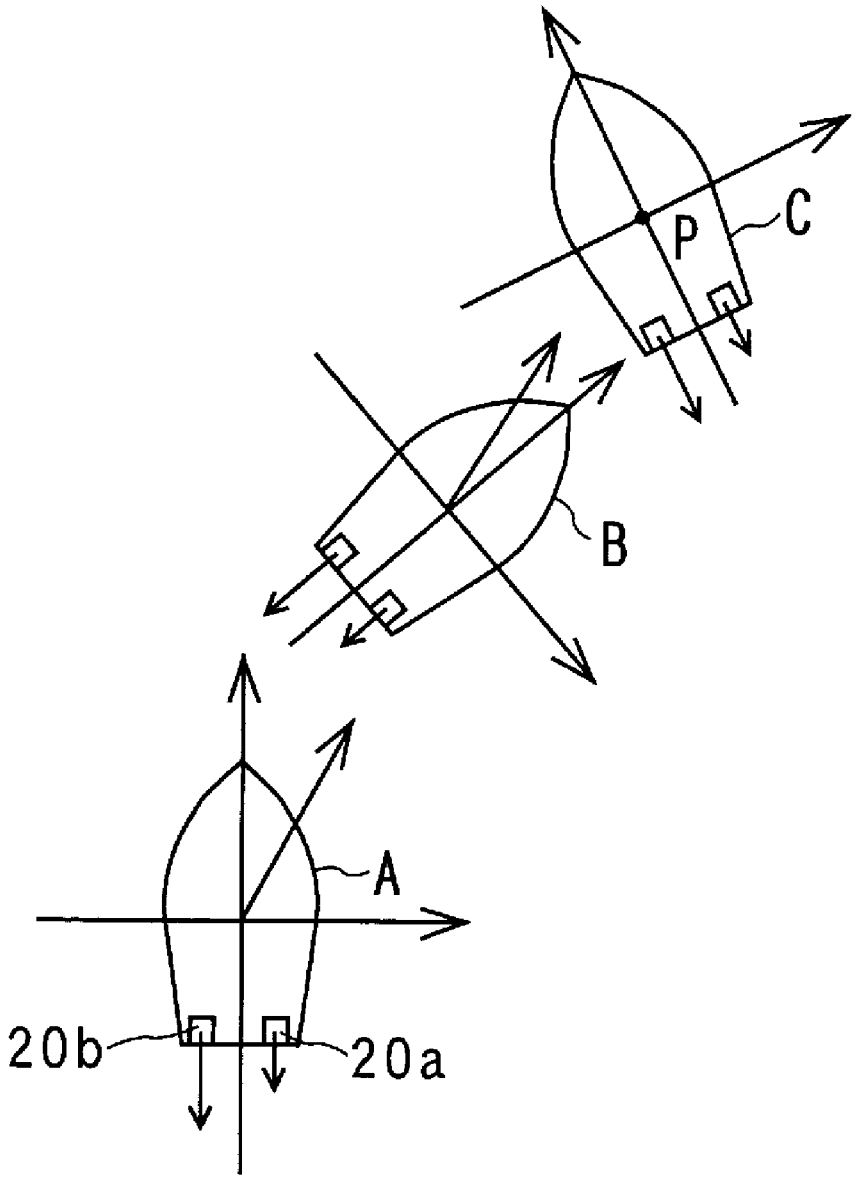
FIG. 32 is a schematic diagram showing a mode of the fixed point retention control for the boat in the second preferred embodiment of the present invention.

As described above, step S41 to step S45 shown in FIG. 23 are repeated over a period of time when the retention switch 94 is on. Consequently, the propulsive force of the outboard motors 20*a* and 20*b* is normally changed a plurality of times until the boat 2 reaches fixed point P, for example as shown in FIG. 32. For example, when the boat 2 is in a position indicated with A in FIG. 32, step S41 to step S45 shown in FIG. 23 are performed once to calculate propulsive force of the outboard motors 20*a* and 20*b*. Then, when the boat 2 reaches a position indicated with B shown in FIG. 32, step S41 to step S45 are performed again to calculate propulsive force of the outboard motors 20*a* and 20*b* again. Then, the boat 2 reaches a position indicated with C in FIG. 32, and the boat 2 returns to fixed point P.

The fixed point retention control in this preferred embodiment will be further specifically described with reference to a time chart illustrated in FIG. 33.

Figure 33:
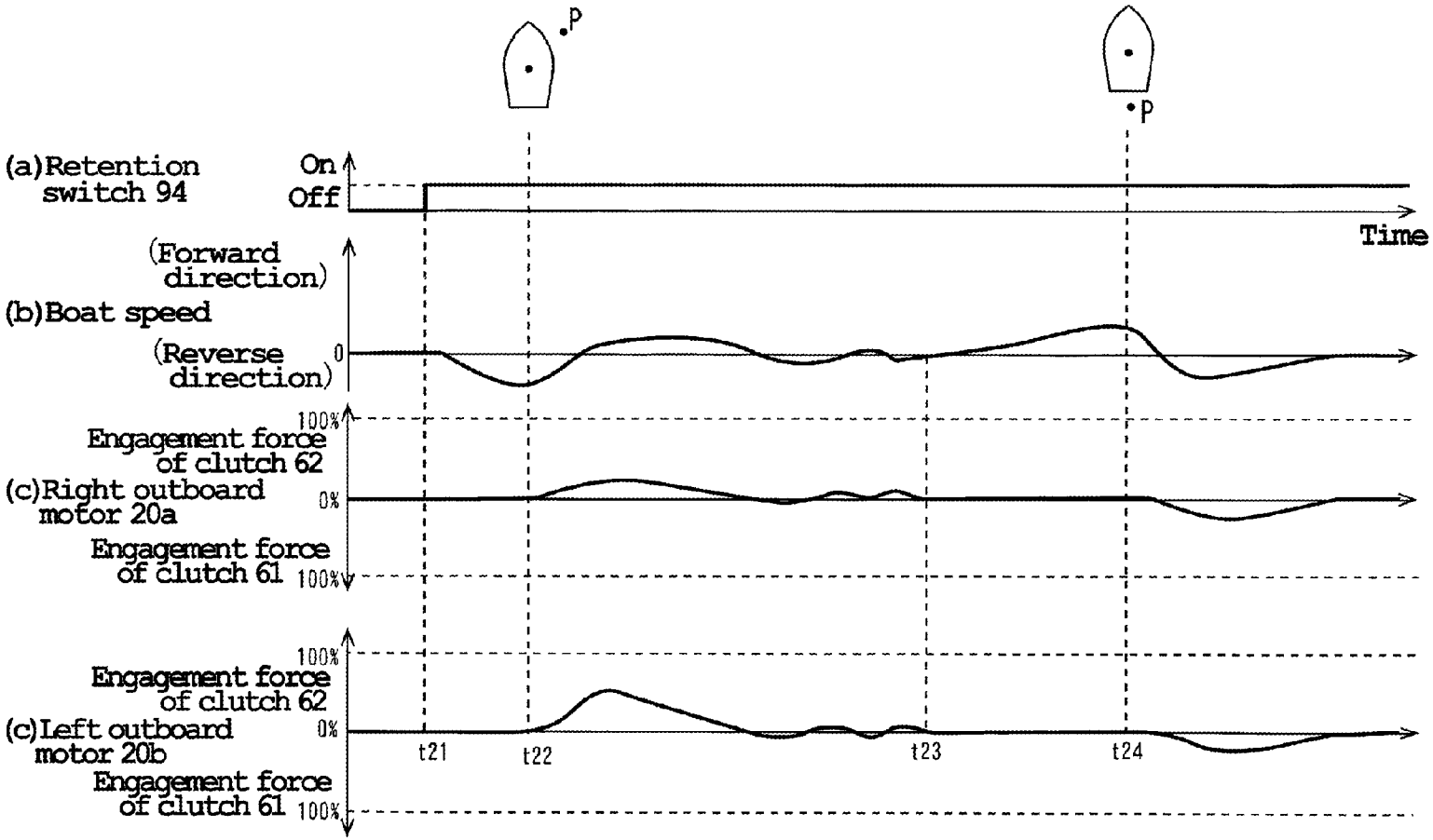
FIG. 33 is a time chart showing an example of the fixed point retention control for the boat in the second preferred embodiment of the present invention.

In the example shown in FIG. 33, the retention switch 94 is turned on at time t21.

In the example shown in FIG. 33, the boat 2 has moved left and rearward from fixed point P in a period from time t21 to t22. Consequently, the engagement force of the second shift position switching hydraulic clutch 62 is enhanced in each of the outboard motors 20*a* and 20*b* from time t22. As a result, propulsive force in the forward direction is generated for the boat 2. However, the engagement force of the second shift position switching hydraulic clutch 62 of the left outboard motor 20*b* is larger than the engagement force of the second shift position switching hydraulic clutch 62 of the right outboard motor 20*a*. Consequently, the propulsive force in the forward direction of the left outboard motor 20*b* becomes larger than the propulsive force in the forward direction of the right outboard motor 20*a* from time t22. Therefore, the boat 2 moves right and forward to a direction of fixed point P.

Further, the boat 2 has moved in the forward direction from fixed point P from time t23 to t24 in the example shown in FIG. 33. Consequently, engagement force of the first shift position switching hydraulic clutch 61 of the right outboard motor 20*a* is enhanced from time t24, and engagement force of the first shift position switching hydraulic clutch 61 of the left outboard motor 20*b* is enhanced. From time t24, the engagement force of the shift position switching hydraulic clutch 61 of the right outboard motor 20*a* and the left outboard motor 20*b* is generally the same as each other. Therefore, the boat 2 is propelled exactly in the rear direction to the direction of fixed point P from time t24.

By disposing a plurality of outboard motors on the boat as in this preferred embodiment, it becomes possible to accurately retain the boat on a fixed point in both the longitudinal direction and the width direction of the hull.

FIRST MODIFICATION EXAMPLE

The case that the boat has two outboard motors is described in the second preferred embodiment above. However, the boat may have three or more boat propulsion systems.

Figure 34:
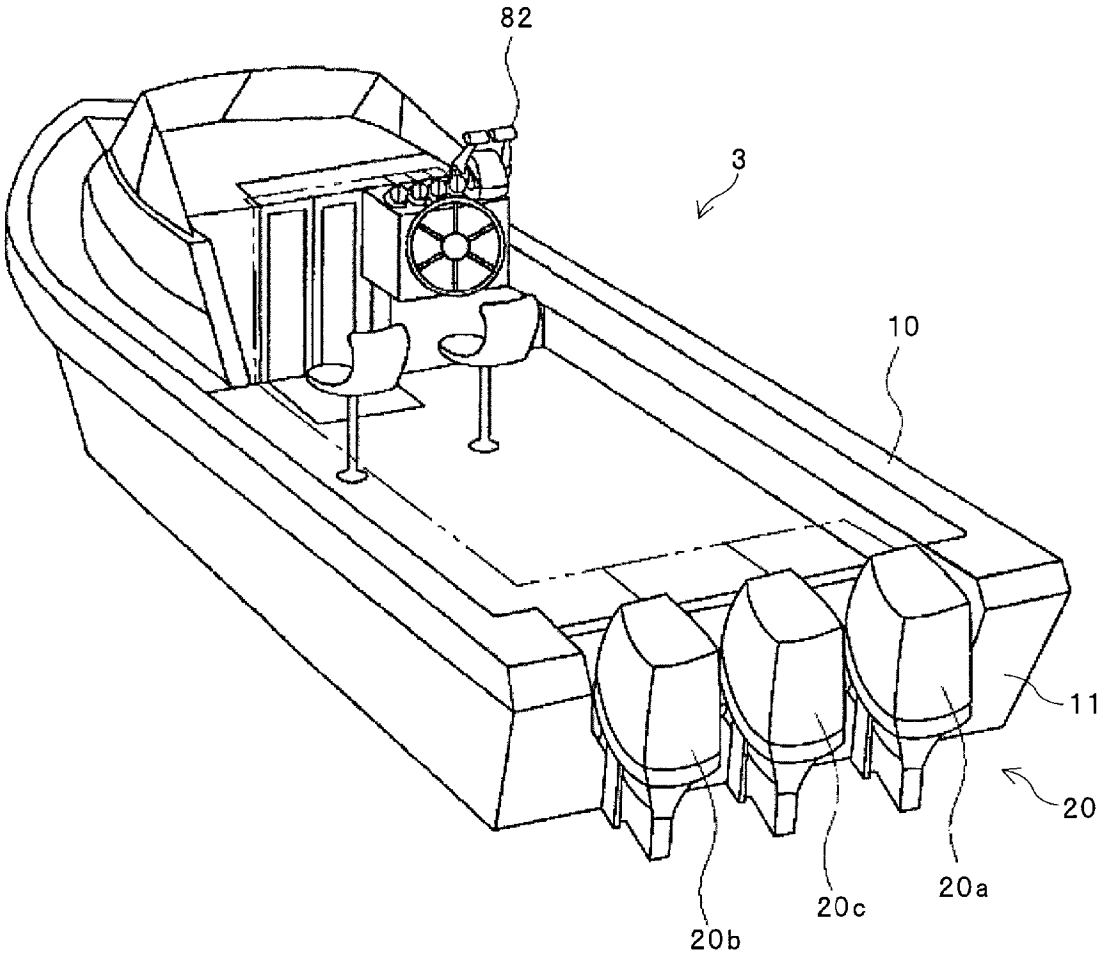
FIG. 34 is a view of a boat according to a first modification example when viewed from an obliquely rearward direction.

For example, as shown in FIG. 34, when the boat 3 has a third outboard motor 20*c* in addition to the right outboard motor 20*a* and the left outboard motor 20*b*, the ECU 86 may retain the shift position switching hydraulic clutches 61 and 62 of the third outboard motor 20*c* to be disengaged during the fixed point retention control. In other words, a shift position of the third outboard motor 20*c* may be neutral.

SECOND MODIFICATION EXAMPLE

In the first preferred embodiment described above, the retention switch 94 and the deceleration switch 95 are provided separately. However, the present invention is not limited to this configuration.

Figure 35:
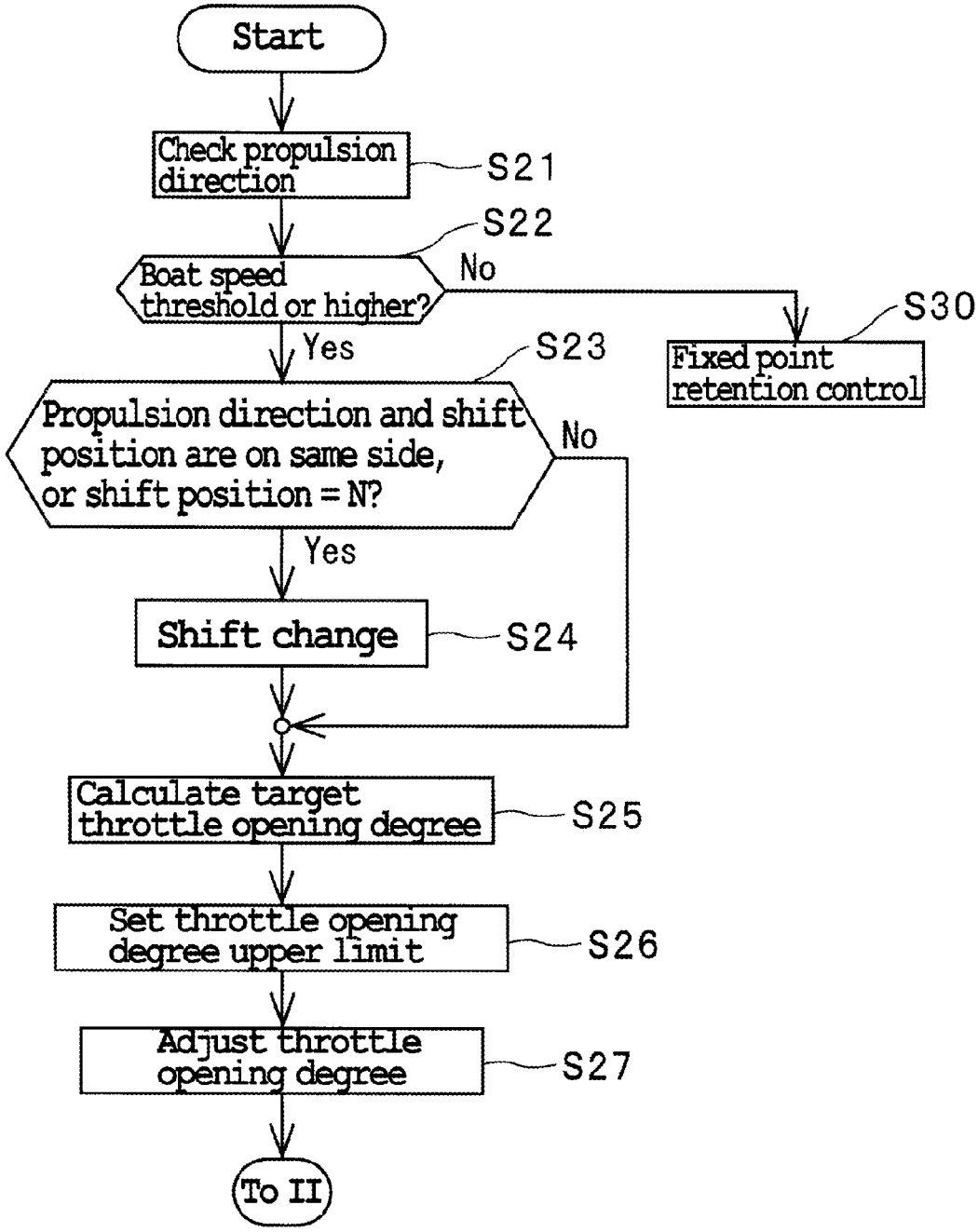
FIG. 35 is a flow chart showing fixed point retention control for the boat in the first modification example.

For example, the deceleration switch 95 may also function as the retention switch 94. In this case, the fixed point retention control in step S30 may be automatically performed when boat speed becomes less than the threshold in step S22, for example as shown in FIG. 35. For example, the fixed point retention control in step S30 may be automatically performed when boat speed becomes substantially 0 in step S22.

THIRD MODIFICATION EXAMPLE

In the first preferred embodiment described above, a fixed point is set to a position of the boat 2 at a time when the retention switch 94 is turned on. However, the present invention is not limited to this configuration. For example, the operator may input a fixed point to the input section 92. In other words, the boat 2 may be retained on the fixed point input to the input section 92.

OTHER MODIFICATION EXAMPLES

In the preferred embodiments described above, the shift position switching mechanism 36 is preferably provided with one planetary gear mechanism 60 and two shift position switching hydraulic clutches 61 and 62. However, the configuration of the shift position switching mechanism is not limited thereto in the present invention. For example, the shift position switching mechanism may be defined with a forward/reverse switching mechanism disposed in an interlocking mechanism and a clutch arranged to connect and disconnect the forward/reverse switching mechanism and the engine 30.

In the preferred embodiments described above, the map arranged to control the transmission gear ratio switching mechanism 35 and the map arranged to control the shift position switching mechanism 36 are preferably stored in the memory 86*b* in the ECU 86 mounted on the outboard motor 20. Further, a control signal for controlling the electromagnetic valves 72, 73, and 74 is output from the CPU 86*a* in the ECU 86 mounted on the outboard motor 20.

However, the present invention is not limited to this configuration. For example, a memory as a storage section and a CPU as an operating section may be provided in the controller 82 mounted on the hull 10 in addition to or in place of the memory 86*b* and the CPU 86*a*. In this case, the map arranged to control the transmission gear ratio switching mechanism 35 and the map arranged to control the shift position switching mechanism 36 may be stored in the memory provided to the controller 82. Further, the CPU provided to the controller 82 may be made to output a control signal for controlling the electromagnetic valves 72, 73, and 74.

In the preferred embodiment described above, the ECU 86 controls both the engine 30 and the electromagnetic valves 72, 73, and 74. However, the present invention is not limited thereto. For example, an ECU arranged to control the engine and an ECU arranged to control the electromagnetic valves may be separately provided.

In the preferred embodiment described above, the controller 82 is a so-called "electronic controller." Here, the "electronic controller" refers to a controller that converts an operation amount of the control lever 83 into an electrical signal and outputs the electrical signal to the LAN 80.

However, the controller 82 may not be an electronic controller in the present invention. For example, the controller 82 may be a so-called mechanical controller. Here, the "mechanical controller" refers to a controller that is provided with a control lever and a wire connected to the control lever and that transfers an operation amount and an operation direction of the control lever to an outboard motor as a physical quantity as an operation amount and an operation direction of the wire.

In the preferred embodiment described above, the shift mechanism 34 has the transmission gear ratio switching mechanism 35. However, the shift mechanism 34 may not have the transmission gear ratio switching mechanism 35. For example, the shift mechanism 34 may have only the shift position switching mechanism 36.

In this specification, the engagement force of a clutch is a value that shows an engagement state of the clutch. In other words, the phrase "engagement force of the transmission gear ratio switching hydraulic clutch 53 is 100%," for example, means that the hydraulic cylinder 53*a* is activated for the plate group 53*b* to be completely compressed, so that the transmission gear ratio switching hydraulic clutch 53 is completely engaged. On the other hand, "engagement force of the transmission gear ratio switching hydraulic clutch 53 is 0%," for example, means that the hydraulic cylinder 53*a* becomes deactivated for the plates in the plate group 53*b* to be separated from each other to be decompressed, so that the transmission gear ratio switching hydraulic clutch 53 is completely disengaged. Further, the phrase "engagement force of the transmission gear ratio switching hydraulic clutch 53 is 80%," for example, means that the transmission gear ratio switching hydraulic clutch 53 is activated for the plate group 53*b* to be compressed, so that a so-called half clutch is made, in which driving torque transmitted from the first power transmission shaft 50 as the input shaft to the second power transmission shaft 51 as the output shaft or rotational speed of the second power transmission shaft 51 is about 80% compared to a state that the transmission gear ratio switching hydraulic clutch 53 is completely engaged.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A boat propulsion unit comprising:

a power source;

a propeller arranged to be driven by the power source to generate a propulsive force;

a shift position switching mechanism having an input shaft connected to the power source, an output shaft connected to the propeller, and a hydraulic clutch arranged to change a connection state between the input shaft and the output shaft, a shift position of the shift position switching mechanism being switched between forward, neutral, and reverse by engaging and disengaging the hydraulic clutch;

a control device arranged to adjust and maintain an engagement force of the hydraulic clutch to be any value in a range of 0% to 100%, including any value between 0% and 100%, of the engagement force of the hydraulic clutch by adjusting a hydraulic pressure applied to the hydraulic clutch and thereby vary a rotational speed of the output shaft with respect to a rotational speed of the input shaft; and a retention switch connected to the control device; wherein when the retention switch is turned on by an operator, the control device controls the engagement force of the hydraulic clutch to assist a hull being retained at or propelled toward a predefined position; and the control device calculates the engagement force of the hydraulic clutch based on a boat speed integral value, which is a speed of the boat integrated over time since the retention switch was turned on.

2. The boat propulsion unit according to claim 1, wherein when the retention switch is turned on by the operator, the control device controls the engagement force of the hydraulic clutch to assist the hull being retained at or propelled toward the predefined position at which the hull was located when the retention switch was turned on.

3. The boat propulsion unit according to claim 1, wherein the hydraulic clutch includes:

a first hydraulic clutch that is engaged when the shift position of the shift position switching mechanism is in the reverse position, and is disengaged when the shift position of the shift position switching mechanism is in the forward or neutral positions; and a second hydraulic clutch that is engaged when the shift position of the shift position switching mechanism is in the forward position and to be disengaged when the shift position of the shift position switching mechanism is in the reverse or neutral positions; and when the retention switch is turned on by the operator, the control deviced disengages the second hydraulic clutch and increases an engagement force of the first clutch if a current position of the hull is more forward than the predefined position and disengages the first hydraulic clutch and increases an engagement force of the second hydraulic clutch if the current position of the hull is more rearward than the predefined position.

4. The boat propulsion unit according to claim 3, wherein the engagement force of the first hydraulic clutch or the second hydraulic clutch is gradually increased in order to increase the engagement force of the first hydraulic clutch or the second hydraulic clutch when the retention switch is turned on by the operator.

5. The boat propulsion unit according to claim 3, wherein the control device is arranged to control the engagement force of the first hydraulic clutch and the engagement force of the second hydraulic clutch based on a distance between the current position of the hull and the predefined position when the retention switch is turned on by the operator.

6. The boat propulsion unit according to claim 1, comprising:

a first boat propulsion unit provided with the power source, the propeller, and the shift position switching mechanism; and a second boat propulsion unit provided with a second power source, a second propeller, and a second shift position switching mechanism; wherein the control device is arranged to cause an engagement force of a hydraulic clutch of the second boat propulsion unit to be larger than an engagement force of a hydraulic clutch of the first boat propulsion unit when the hull is located on one side in the width direction of the hull with respect to the predefined position when the retention switch is turned on by the operator.

7. The boat propulsion unit according to claim 6, further comprising:

a third boat propulsion unit provided with a third power source, a third propeller, and a third shift position switching mechanism, the third boat propulsion unit being disposed between the first boat propulsion unit and the second boat propulsion unit in the width direction of the hull; wherein the control device is arranged to keep a hydraulic clutch of the third boat propulsion unit disconnected when the retention switch is turned on by the operator.

8. The boat propulsion unit according to claim 1,further comprising:

a deceleration switch connected to the control device; wherein the control device is arranged to control the engagement force of the hydraulic clutch such that the propeller generates propulsive force in an opposite direction to a current propulsion direction of the hull when the deceleration switch is turned on by the operator, and if the deceleration switch remains on when a propulsion speed of the hull becomes substantially zero, controls the engagement force of the hydraulic clutch to assist the hull being retained at or propelled toward a position in which the hull is located when the propulsion speed of the hull becomes substantially zero.

9. The boat propulsion unit according to claim 1, wherein the hydraulic clutch is a multi-plate clutch.

10. The boat propulsion unit according to claim 1, wherein the control device includes:

an actuator; and a control section arranged to control the actuator; and the actuator includes:

an oil pump arranged to generate the hydraulic pressure to engage and disengage the hydraulic clutch;

an oil path arranged to connect the oil pump and the hydraulic clutch; and a valve disposed in the oil path arranged to gradually change a flow area of the oil path.

11. The boat propulsion unit according to claim 1, further comprising a memory arranged to store a map defining a relationship between the boat speed integral value and the engagement force of the hydraulic clutch, wherein the control device calculates the engagement force of the hydraulic clutch by applying the boat speed integral value to the map.

* * * * *